US010704279B2

(12) United States Patent
Hohmann et al.

(10) Patent No.: US 10,704,279 B2
(45) Date of Patent: Jul. 7, 2020

(54) SUPPORT POST

(71) Applicant: DOKA GMBH, Amstetten (AT)

(72) Inventors: Eberhard Hohmann, Rockenberg (DE); Dietmar Wagner, Amstetten (AT)

(73) Assignee: DOKA GMBH, Amstetten (AT)

( * ) Notice: Subject to any disclaimer, the term of this patent is extended or adjusted under 35 U.S.C. 154(b) by 0 days.

(21) Appl. No.: 16/255,493

(22) Filed: Jan. 23, 2019

(65) Prior Publication Data

US 2019/0226220 A1 Jul. 25, 2019

Related U.S. Application Data

(63) Continuation-in-part of application No. 15/878,383, filed on Jan. 23, 2018, and a continuation-in-part of application No. 15/878,379, filed on Jan. 23, 2018, now abandoned.

(51) Int. Cl.

| | |
|---|---|
| ***E04G 21/24*** | (2006.01) |
| ***E04H 17/20*** | (2006.01) |
| ***E04G 21/32*** | (2006.01) |

(52) U.S. Cl.

CPC ..... *E04G 21/243* (2013.01); *E04G 21/32* (2013.01); *E04G 21/3233* (2013.01); *E04H 17/20* (2013.01)

(58) Field of Classification Search

CPC ... E04G 21/243; E04G 21/32; E04G 21/3233; E04H 17/20

USPC ..... 52/844

See application file for complete search history.

(56) References Cited

U.S. PATENT DOCUMENTS

| | | | | |
|---|---|---|---|---|
| 2,337,796 | A * | 12/1943 | Baker | E04F 21/1822 414/11 |
| 2,997,126 | A * | 8/1961 | Morgen | E04G 1/20 182/148 |
| 5,647,693 | A * | 7/1997 | Carlinsky | B63B 35/44 405/229 |
| 5,775,847 | A * | 7/1998 | Carlinsky | E02D 27/32 405/229 |
| 8,490,930 | B2 * | 7/2013 | Huang | B60P 7/15 248/122.1 |

(Continued)

OTHER PUBLICATIONS

Hohmann, E. et al. ,"Support Post," U.S. Appl. No. 15/878,379, filed Jan. 23, 2018, 60 pages.

*Primary Examiner* — Jeanette E Chapman
(74) *Attorney, Agent, or Firm* — McCoy Russell LLP

(57) ABSTRACT

A support post for releasable fixation between a first and a second floor, comprising:

a first and a second elongate member telescopically connected to one another, first floor and second floor engaging members positioned at the ends of the first and second elongate members, a displacement unit for displacing the first floor engaging member, a spring biasing the first floor engaging member in a direction away from the first elongate member, the first floor engaging member being moveable in towards the upper end of the first elongate member against the force of the spring, a first inspection window in the first elongate member, a second inspection window adjacent to the first inspection window, an indicator having a first marking arranged at the second inspection window in a relaxed state of the spring, and having a second marking arranged at the second inspection window in a loaded state of the spring.

9 Claims, 34 Drawing Sheets

(56) References Cited

U.S. PATENT DOCUMENTS

| | | | | |
|---|---|---|---|---|
| 2006/0022426 | A1* | 2/2006 | Clive-Smith | B65D 88/005 280/278 |
| 2007/0151195 | A1* | 7/2007 | Huang | E04G 25/08 52/651.07 |
| 2015/0176304 | A1 | 6/2015 | Melic | |

* cited by examiner

SUPPORT POST

CROSS REFERENCE TO RELATED APPLICATIONS

The present application is a continuation-in-part of U.S. Non-Provisional patent application Ser. No. 15/878,383, entitled "SUPPORT POST", and filed on Jan. 23, 2018. The present application is a continuation-in-part of U.S. Non-Provisional patent application Ser. No. 15/878,379, entitled "SUPPORT POST", and filed on Jan. 23, 2018. The entire contents of each of the above-listed applications are hereby incorporated by reference for all purposes.

TECHNICAL FIELD

The present disclosure generally relates to support posts for fence panels. The disclosure further relates to a temporary barrier having a plurality of support posts and fence panels attached thereto.

DESCRIPTION OF THE RELATED ART

In the construction of a building, a temporary barrier (edge protection) needs to be installed at the perimeter of the building between two floors to ensure the safety of construction workers and passersby on the ground. The temporary barrier typically comprises a number of support posts secured between two floors e.g. made of concrete and an arrangement of fence panels attached to the support posts. Such temporary barriers are known in the prior art, see for example US 2015/176304.

It is an object of the disclosure to improve on the known support posts available in the prior art. In particular, the disclosure aims at providing for a reliable, easy-to-use and variable support post for installation in a temporary barrier at the perimeter of a building under construction.

SUMMARY OF THE PRESENT DISCLOSURE

In accordance with an aspect of the present disclosure, a support post for releasable fixation between a first floor and a second floor comprises:

a first and a second elongate member, the first and second elongate member being telescopically connected to one another, a first floor engaging member positioned at the upper end of the first elongate member, a second floor engaging member positioned at the lower end of the second elongate member, a displacement unit for displacing the first floor engaging member in direction of a longitudinal axis of the first elongate member, a spring biasing the first floor engaging member in a direction away from the upper end of the first elongate member, the first floor engaging member being moveable in direction towards the upper end of the first elongate member against a spring force of the spring, a first inspection window in the first elongate member, a second inspection window slidably arranged adjacent to the first inspection window, an indicator, the indicator having a first marking and a second marking, the first marking being arranged at the second inspection window in a relaxed state of the spring, the second marking being arranged at the second inspection window in a loaded state of the spring.

The displacement unit is moveable between a first and second position corresponding to a fully retracted and fully extended position of the first floor engaging member in its unloaded state, respectively (that is, without counter-pressure from the first floor holding down the first floor engaging member against the force of the spring). However, the proper installation of the support post between the first and second floor requires the loading (tensioning) of the spring such that the first floor engaging member is urged against the first floor by spring force. Thus, arranging the displacement unit in the second position could be insufficient to ensure the required tension in the support post, if the first elongate member initially was inadequately extended from the second elongate member so that the vertical displacement of the first floor engaging member does not result in the loading of the spring by means of the engagement with the first floor. On the other hand, the support post of the embodiment avoids such malfunctioning with the indicator which indicates to the user the loaded (tensioned) or relaxed state of the spring in the second position of the displacement unit (i.e. after urging the first floor engaging member upwards). The first and second markings are arranged at the outer surface of the indicator at vertically spaced positions. The first marking is arranged at the second inspection window, if the spring is still relaxed after actuation of the displacement unit in direction of the second position thus indicating an insufficient tensioning of the support post. For example, the first marking may be of red color to signal improper installation of the support post. On the other hand, the second marking is arranged at the second inspection window in the second position of the displacement unit, if the spring is loaded. The second color may be of green color to signal proper installation of the support post. This embodiment helps to improve the safety of the support post. The first inspection window is arranged such that it allows inspection of the second inspection window both in the first and in the second position of the displacement unit. For this purpose, the first inspection window has a larger vertical extension than the second inspection window or it comprises at least two distinct windows. The second inspection window and the second marking are arranged such that the second marking is visible through the second inspection window as long as the spring is tensioned by at least a required minimum tension for safely fixing the support post between first floor and second floor.

In an embodiment, the indicator is connected to the first floor engaging member via an elongate connector. Optionally, the indicator has a rod with a lower end attached to the indicator and an upper end attached to the first floor engaging member.

In an embodiment, the second inspection window is coupled to a first end of the spring and the indicator is coupled to a second end of the spring such that a linear displacement of the first end of the spring leads to the linear displacement of the second inspection window by the same distance and a linear displacement of the second end of the spring leads to the linear displacement of the indicator by the same distance.

It is advantageous if the displacement unit comprises an elongate force transfer member acting on a bearing for the first end of the spring. In an embodiment, the second end of the spring acts on the first floor engaging member.

In an embodiment, the elongate force transfer member comprises the second inspection window. The elongate force transfer member can be telescopically mounted inside the first elongate member.

It is advantageous if the indicator is connected to the first floor engaging member via an elongate connector. In an embodiment, the support post comprises a bracket member having the indicator. The bracket member may be floatingly mounted inside the first elongate member and inside the elongate force transfer member. Advantageously, the bracket member is connected to the elongate connector.

The first inspection window may be a through-opening of the first elongate member or a section of the first elongate member may be made of a transparent material to allow inspection of the indicator arranged inside the first elongate member and the force transfer member from outside of the support post. The second inspection window may be a through-opening of the elongate force transfer member or a section of the elongate force transfer member may be made of transparent material to allow inspection of the indicator arranged inside the force transfer member from the outside of the support post.

In accordance with an aspect of the present disclosure, a support post for releasable fixation between a first floor and a second floor comprises:

a first and a second elongate member, the first and second elongate member being telescopically connected to one another, a first floor engaging member positioned at the upper end of the first elongate member, a second floor engaging member positioned at the lower end of the second elongate member, the first or second floor engaging member having a plurality of clamping plates arranged side by side, the clamping plates, at an upper end of the first floor engaging member or at a lower end of the second floor engaging member, having tapered surfaces for engaging the first or second floor, respectively.

In this embodiment, the tapered surfaces of the clamping plates bite into the first or second floor when the support post is anchored between the first and second floor. The first and the second floor may be made of concrete. The clamping plates are mounted side-by-side, i.e. two main sides of two neighboring clamping plates abut on each other and, optionally, are identical in shape and dimension. This embodiment is particularly simple and robust. Furthermore, the clamping plates may be slightly moveable against one another which improves grip on the first or second floor. Optionally, each of the first and second floor engaging member has a plurality of clamping plates arranged side by side.

For the purpose of this disclosure, all directional and positional indications, such as "upper", "lower", "vertical", "horizontal", are given with respect to a vertical arrangement of the support post when installed between two adjacent floors of a building under construction. However, it will be appreciated that the support post could be mounted at any angle between two floors in which case the directional and positional indications need to be transposed accordingly.

In an embodiment, the support post comprises a spring biasing the first floor engaging member in a direction away from the upper end of the first elongate member, the first floor engaging member being moveable in direction towards the upper end of the first elongate member against a spring force of the spring. When installing the support post between the first and second floor, the spring may be tensioned such that the first floor engaging member is pressed against the first floor. In this way, the support post is securely anchored between the first and second floor.

In an embodiment, the clamping plates of the first or second floor engaging member are pivotally mounted on the first elongate member or second elongate member, respectively. In this embodiment, the free ends of the clamping plates having the tapered surfaces can be tilted against one another when the first or second floor engaging member is brought in contact with the first or second floor, respectively. This construction improves the grip between the clamping plates and the concrete of the first or second floor, respectively. In view of the surface structure of typical floors the tilting angle of the clamping plates with respect to a central (middle) position of the clamping plates in both directions optionally is less than 5 degrees. For example, a maximum total tilting angle between neighboring clamping plates (tilted in opposite directions) may be less than 3 degrees.

In an embodiment, the clamping plates of the first or second floor engaging member are pivotable about a pivot axis extending perpendicularly to a longitudinal axis of the first or second elongate member, respectively. In the installed state of the support post, the clamping plates may be slightly turned out of their original, congruent position as a result of the surface structure of the first or second floor, respectively. In this way, the support post safely engages the first and second floor.

In an embodiment, the first or second floor engaging member has a first pin and a second pin extending transversely through first and second through-holes of the plurality of clamping plates at vertically spaced positions, respectively, the second pin being arranged in the second through-holes of the clamping plates with a clearing to allow for pivoting of the clamping plates about the first pin. In this embodiment, the first pin snugly fits into the first through holes of the clamping plates, whereas a circumferential clearance is provided for the arrangement of the second pin in the second through holes of the clamping plates. In combination, this allows for pivoting of the clamping plates about the pivot axis formed by the first pin. When the support post is to be installed, the clamping plates can, thus, flexibly and easily adapt to an unevenness of the surface of the first and second floor, nonetheless securely engage with the first and second floor.

In an embodiment, the first or second floor engaging member has at least three clamping plates with tapered surfaces for engaging the first or second floor, respectively.

In an embodiment, each clamping plate has two spikes each having one tapered surface. This facilitates the clamping plate to claw into the surface of the first and second floor made of concrete.

In an embodiment, the two spikes are formed by cut-outs of the clamping plates. This construction is particularly simple.

In accordance with another aspect of the present disclosure, a support post for releasable fixation between a first floor and a second floor comprises:

a first and a second elongate member, the first and second elongate member being telescopically connected to one another, a first floor engaging member positioned at the upper end of the first elongate member, a second floor engaging member positioned at the lower end of the second elongate member, a foot member arranged at the lower end of the second elongate member, the foot member having an upwardly extending guide protrusion for accommodating and guiding a lower frame member of a fence panel perpendicularly to a longitudinal axis of the second elongate member.

A temporary barrier system for securing the perimeter of a building under construction has a number of fence panels and a number of support posts to which the fence panels are attached. To allow for a variable arrangement as well as easy assembly and disassembly of fence panels and support posts at different construction sites, the support post of this embodiment has a foot member with an upwardly projecting guide protrusion that, in use, accommodates a correspondingly shaped opening extending along the lower frame member of the fence panel. This gives sufficient stability to the fence panel in direction perpendicular to the main plain of the fence panel while guiding the fence panel laterally (i.e. in direction of an edge at the perimeter of the second floor). Thus, the lower frame member of the fence panel may slide over the guide protrusion at the foot member of the support post in direction of the lower frame member of the fence panel. As an advantage of this embodiment, it may not be necessary to connect the side frame members of the fence panel to two support posts. A fence panel may be used having a lateral extension larger than the distance between two neighboring support posts, wherein the fence panel at one side is guided by means of the foot member of the respective support post, the fence panel extends close to this support post, whereas its side overlaps with a neighboring fence panel.

In an embodiment, the foot member is adjustable in direction of the longitudinal axis of the second elongate member. This construction improves the variability of the temporary barrier system.

In an embodiment, the foot member has a horizontal flange for abutment on the second floor and a vertical flange slidably arranged at the lower end of the second elongate member, the guide protrusion extending upwardly from a top side of the horizontal flange of the foot member. In this embodiment, a lower frame of a fence panel can easily be received.

In an embodiment, the guide protrusion is rectangular in cross-section to snugly fit into a U-shaped opening formed in the lower frame member of the fence panel. Hence, retaining the lower frame member of the fence panel and preventing the fence panel from an undesired tilting is facilitated.

In an embodiment, the foot member has an elongate slot extending vertically at the vertical flange, the elongate slot accommodating a pin at the lower end of the second elongate member. For adjusting the vertical position (i.e. the height) of the foot member, the foot member is moved upwards or downwards via the elongate slot in the vertical flange.

In accordance with another aspect of the present disclosure, a support post for releasable fixation between a first floor and a second floor comprises:

a first and a second elongate member, the first and second elongate member being telescopically connected to one another, a first floor engaging member positioned at the upper end of the first elongate member, a second floor engaging member positioned at the lower end of the second elongate member, a blocking member for selectively blocking or releasing a retraction of the first elongate member with respect to the second elongate member, the blocking member having a blocking plate with an aperture for passing the first elongate member therethrough.

In this embodiment, the vertical extension of the support post may be continuously adjusted by telescoping the first elongate member with respect to the second elongate member. When the blocking member is arranged in a blocking position, the blocking plate resists the retraction of the first elongate member with respect to the second elongate member. On the other hand, the blocking member releases the extension of the support post when the first elongate member is arranged in a release position, in which the first elongate member may be passed through the through aperture of the blocking plate. This construction allows for great variability and reliability in the anchoring of the support post. In particular, the support post enables the precise adjustment to different vertical spacings between adjacent floors of a building under construction. Furthermore, the blocking plate is arranged for receiving high loads when the support post is installed at the construction site.

In an embodiment, the blocking member, in a blocking position, blocks the retraction of the first elongate member with respect to the second elongate member while releasing the extension of the first elongate member with respect to the second elongate member. This greatly facilitates the anchoring of the support post between the first and the second floor. In particular, the first elongate member may be telescoped from the second elongate member until the first floor engaging member contacts the first floor while the blocking member is arranged in the blocking position resisting an involuntary retraction of the first elongate member. For disengaging the support post, the blocking member is brought into a release position which allows for both of extending and retracting the first elongate member with respect to the second elongate member.

In an embodiment, an aperture wall of the blocking plate, in a blocking position, engages an outer wall of the first elongate member, the aperture wall of the blocking plate, in a release position, disengaging the outer wall of the first elongate member. Thus, the blocking plate, in the blocking position, jams the first elongate member so that the support post is reliably fixed at the given vertical extension. Furthermore, the retraction of the support post may be easily released by moving the blocking plate into the release position, thereby bringing the aperture out of contact with the first elongate member. Optionally, the aperture of the blocking member is larger in cross-section than the first elongate member so that the blocking member, in the release position, does not restrict the vertical displacement of the first elongate member.

In an embodiment, the blocking plate of the blocking member is pivoted about a pivot axis between a blocking position for blocking the retraction of the first elongate member and a release position for releasing the retraction of the first elongate member. This construction facilitates the engagement or disengagement of the first elongate member by means of the blocking member. By pivoting the blocking plate in a first direction into the blocking position, the aperture wall of the blocking plate is pressed against the outer surface of the first elongate member such that the retraction (i.e. downward movement) of the first elongate member is blocked. In the same manner, the blocking plate is pivoted into a second, opposite direction for disengaging the blocking member from the first elongate member, thereby releasing the retraction of the support post. Thus, the support post may be safely arranged at continuous total vertical extensions depending on the dimensions of the building under construction.

In an embodiment, the blocking plate is pivoted by at least 3 degrees, for example by at least 5 degrees, between the blocking position and the release position.

In an embodiment, the pivot axis of the blocking plate extends perpendicularly to a longitudinal axis of the first elongate member. Thus, the blocking plate is pivoted downwards or upwards to engage or disengage the first elongate member.

In an embodiment, the blocking plate of the blocking member, in the blocking position, is arranged inclined with respect to a horizontal plain. Optionally, the inclination is at least 8 degrees, optionally at least 10 degrees, optionally around 14 degrees, with respect to the horizontal plain. Due to the inclined arrangement of the blocking plate in the blocking position, the aperture wall of the blocking plate bites into the outer surface of the first elongate member, thus resisting the vertical retraction of the first elongate member.

In an embodiment, the blocking plate of the blocking member, in the blocking position, extends downwardly in direction away from the pivot axis. The pivot axis is arranged outside of and spaced from the first elongate member. In this embodiment, the blocking member, in the blocking position, is inclined downwards from a first end at the side of the pivot axis.

In an embodiment, the blocking plate of the blocking member, in the release position, is arranged horizontally. This facilitates the arrangement of the first elongate member inside the aperture of the blocking plate with a circumferential clearance when the blocking member is in the release position so that the first elongate member may be easily retracted into the second elongate member.

In an embodiment, a spring member biases the blocking plate in direction of the blocking position. This construction greatly improves the safety in the use of the support post. The extension of the support post can only be changed by actively bringing the blocking member, against the spring force of the spring member, into the release position. Otherwise, the spring member urges the blocking member into the blocking position for resisting the retraction of the support post.

In an embodiment, the spring member is a torsion spring arranged about the pivot axis. This construction ensures the required spring force to maintain the blocking member in the blocking position unless the blocking member is actively moved into the release position.

In an embodiment, the blocking member is housed in a housing, the housing being secured to the second elongate member. In this way, the safety of users of the support post is improved. The housing may have an access opening for inserting an instrument, for example a screwdriver, for moving the blocking member into the release position.

In an embodiment, the blocking member is connected to a support member being supported on the second elongate member. In this way, the loads from the blocking member are transferred via the support member into the second elongate member and thus into the second floor supporting the support post from below.

In an embodiment, the support member is supported on an upper end of the second elongate member. This has the effect that the vertical loads from the blocking member are longitudinally transferred into the second elongate member.

In an embodiment, the support member is a support plate. This construction is particularly simple, robust, light-weight and reliable.

In an embodiment, the support plate is connected to the blocking plate by means of a pin defining the pivot axis. This allows for effective load transfer and simple transfer between the blocking position and the release position.

In accordance with an aspect of the present disclosure, a support post for releasable fixation between a first floor and a second floor comprises:

a first and a second elongate member, the first and second elongate member being telescopically connected to one another, a first floor engaging member positioned at the upper end of the first elongate member, a second floor engaging member positioned at the lower end of the second elongate member, a first latch member for latching a fence panel to the support post, a vertical guide member with an opening for accommodating a side frame member of a fence panel, the vertical guide member being vertically spaced from the first latch member.

This construction makes the attachment of the fence panel to the support post particularly simple. The first latch member releasably connects the fence panel to the support post such that the fence panel may not be laterally removed from the support post. The vertical guide member, on the other hand, receives the side frame member of the fence panel to restrict the displacement of the fence panel perpendicularly to its main plain. In combination, the first latch member and the vertical guide member allow for the stable, easy and fast connection of the fence panel to the support post with a vertical arrangement of the fence panel (safety screen). As the vertical guide member simply guides the side frame member vertically but does not latch the side frame member, the disconnection of the fence panel is particularly simple and entails but the release of the first latch member.

In an embodiment, the vertical guide member is arranged below the first latch member. In this way, the vertical arrangement of the fence panel is secured at a lower region of the main frame (i.e. perpendicularly to the longitudinal extension of a lower frame member in a horizontal plain). Both of the first latch member and the vertical guide member may be mounted on the second elongate member.

In an embodiment, the opening of the vertical guide member is unobstructed. This facilitates the arrangement of the side frame of the fence panel inside the vertical guide member. In particular, it is not required to overcome a latching or locking force when arranging the side frame of the fence panel in the opening of the vertical guide member, as the first latch member releasably latches the fence panel to the support post.

In an embodiment, a second latch member is arranged about the first elongate member, the second latch member being freely moveable in direction of a longitudinal axis of the first elongate member, the second latch member being supported from below at the upper end of the second elongate member. This feature facilitates the connection of another fence panel on top of the fence panel connected to the first latch member and vertical guide member, respectively. By means of the floating arrangement of the second latch member on the first elongate member, the extension or retraction of the first elongate member does not change the vertical position of the second latch member on the first elongate member. In this way, the safety of workers is improved as the rapid retraction of the first elongate member does not entail the danger of trapping a worker's body parts between the second latch member and the second elongate member (or other parts connected thereto).

In accordance with an aspect of the present disclosure, a support post for releasable fixation between a first floor and a second floor comprises:

a first and a second elongate member, the first and second elongate member being telescopically connected to one another, a first floor engaging member positioned at the upper end of the first elongate member, a second floor engaging member positioned at the lower end of the second elongate member, a displacement unit for displacing the first floor engaging member in direction away from an upper end of the first elongate member, the displacement unit having a slide member connected to one of the first floor engaging member and the first elongate member and a guide member connected to the other of the first floor engaging member and the first elongate member, the guide member having a curved surface for supporting the slide member thereon.

For anchoring the support post (pole) between the first and second floor, the support post is first extended until the first floor engaging member contacts the first floor. Then, the displacement unit is actuated to push the first floor engaging member upwards and thus engage the first floor engaging member with the first floor. Optionally, the upward displacement of the first floor engaging member can be constrained by overcoming the force of a spring urging the first floor engaging member upwards. In this way, the first floor engaging member is pressed against the first floor by spring force when the displacement unit attempts to move the first floor engaging member upwards. This facilitates the secure installation of the support post between the first and second floor.

In this embodiment, the sliding motion of the slide member on the curved surface of the guide member between a first and a second position is transferred into a vertical displacement of the first floor engaging member to engage or disengage the first floor engaging member with the first floor. This construction facilitates the actuation of the displacement unit and allows for the effective force transfer onto the first floor engaging member.

In an embodiment, the first and/or second floor engaging member has a claw with a tapered surface for engaging the first or second floor, respectively.

In an embodiment, the slide member is connected to the first floor engaging member and the guide member is connected to the first elongate member. However, the slide member may also be connected to the first elongate member and the guide member connected to the first floor engaging member.

In an embodiment, the guide member is pivotable about a transverse axis extending perpendicular to a longitudinal axis of the first elongate member. By pivoting the guide member the slide member travels on the curved guiding surface of the guide member thus vertically displacing the first floor engaging member to engage or disengage the first floor, respectively. This construction allows for the transfer of high forces to the first floor engaging member. Furthermore, the use of the displacement unit is intuitive and easy.

In an embodiment, the guide member has a first indentation at the curved surface for receiving the slide member in a first position corresponding to a fully retracted position of the first floor engaging member, the guide member further having a second indentation at the curved surface for receiving the slide member in a second position corresponding to a fully extended position of the first floor engaging member. Thus, the slide member can be stably arranged in at least the first and second distinct position at the curved surface of the guide member. The first position corresponds to the fully retracted position of the first floor engaging member with respect to the first elongate member (referring to an unloaded state of the first floor engaging member). The second position corresponds to the fully extended position of the first floor engaging member with respect to the first elongate member (again referring to an unloaded state of the first floor engaging member).

In an embodiment, the guide member has at least one interface for releasably connecting a tool for manipulating the guide member thereto. Thus, for engaging the support post with the first and second floor, the tool is connected to the interface of the guide member. By applying force to the tool, in particular by pivoting the tool, the slide member is transferred from the first position to the second position and vice versa.

In an embodiment, the support post further comprises a spring biasing said first floor engaging member in a direction away from the upper end of the first elongate member, the first floor engaging member being moveable in direction towards the upper end of the first elongate member against a spring force of the spring, an elongate force transfer member connected to the slide member and to the spring, respectively, wherein the sliding motion of the slide member on the curved surface of the guide member is transferred into a linear displacement of the elongate force transfer member for loading the spring.

In this embodiment, the elongate force transfer member is arranged between the slide member and the spring. In this way, the guide member and the first floor engaging member may be vertically spaced from one another. Optionally, the elongate force transfer member is a hollow metal part. The elongate force transfer member may have a through-hole for accommodating the slide member. Optionally, the slide member is a pin with at least one end supported on the curved surface of the guide member.

In an embodiment, the guide member has two curved surfaces on opposite sides of the first elongate member. Optionally the slide member is supported on both of the two curved surfaces of the guide member. This construction facilitates the force transfer from the guide member into the slide member.

In accordance with an aspect of the present disclosure, a support post for releasable fixation between a first floor and a second floor comprises:

a first and a second elongate member, the first and second elongate member being telescopically connected to one another, a first floor engaging member positioned at the upper end of the first elongate member, a second floor engaging member positioned at the lower end of the second elongate member, a level for indicating an inclination of the first or second elongate member, the level having a holder with a magnet for releasably connecting the level to the first or second elongate member.

Thus, the level is releasably connected to one of the first or second elongate members by means of the magnet which may be arranged at an inner surface of a holder for receiving the first or second elongate member. Optionally, the level has at least one bubble level, and optionally two bubble levels arranged cross-wise.

In accordance with an aspect of the present disclosure, a support post for releasable fixation between a first floor and a second floor comprises:

a first and a second elongate member, the first and second elongate member being telescopically connected to one another, a first floor engaging member positioned at the upper end of the first elongate member, a second floor engaging member positioned at the lower end of the second elongate member, a shock absorber arranged at an upper side of the second floor engaging member inside the second elongate member, the shock absorber contacting the lower end of the first elongate member in a fully retracted state of the first elongate member with respect to the second elongate member.

In this embodiment, the shock absorber absorbs the impact resulting from a rapid retraction of the first elongate member into the second elongate member. Optionally, the shock absorber is made of a rubber material. The shock absorber may have a shock absorbing plate arranged perpendicularly to the longitudinal axis of the second elongate member. Optionally, the shock absorber snugly fits into the hollow interior of the second elongate member.

In accordance with an aspect of the present disclosure, a support post for releasable fixation between a first floor and a second floor comprises:

a first and a second elongate member, the first and second elongate member being telescopically connected to one another, a first floor engaging member positioned at the upper end of the first elongate member, a second floor engaging member positioned at the lower end of the second elongate member, a safety device for preventing the first and second elongate member from being disconnected from one another, the safety device having a locking member connected to the first elongate member and a locking opening at the second elongate member, the locking opening receiving the locking member in a fully extended position of the first elongate member with respect to the second elongate member, the safety device further having a spring member biasing the locking member in direction perpendicular to a longitudinal axis of the first elongate member.

In use, the safety device ensures that the first and second elongate member remain assembled and do not undesirably separate from each other, for example during transport of the support post. The locking member optionally is a locking pin connected to the first elongate member. In the fully extended position of the first elongate member, the locking member is received in the locking opening to block the telescoping movement of the first elongate member. The spring member urges the locking member in a direction perpendicular to the longitudinal axis of the first elongate member. If the first elongate member is extended to the fully extended position, the spring member pushes the locking member into the locking opening formed in the wall of the second elongate member. In this way, the support post is locked in its fully extended state. This embodiment helps increase the safety of use of the support post. The safety device of this embodiment is particularly reliable and robust.

In an embodiment, the safety device further has a bracket connected to the locking member and an impact plate connected to the bracket, the impact plate being arranged at an open lower end of the first elongate member. This facilitates the mounting of the safety device at the lower end of the first elongate member and further distributes the forces when the first elongate member is rapidly retracted into the second elongate member.

In an embodiment, the shock absorber is arranged at an upper side of the second floor engaging member inside the second elongate member, the shock absorber contacting the impact plate at the open lower end of the first elongate member in a fully retracted state of the first elongate member with respect to the second elongate member.

The support post in one of the embodiments explained above may be included in a temporary barrier for installation at a perimeter of a building, the temporary barrier comprising at least one such support post and a fence panel connected thereto. The support post has at least one connection, in particular a latch connection, for releasably connecting the fence panel thereto.

In accordance with another aspect of the present disclosure, a support post comprises:

a first latch member for latching a fence panel to the support post, and a vertical guide member with an opening for accommodating a side frame member of a fence panel, the vertical guide member being vertically spaced from the first latch member.

In this embodiment, the support post may be a telescopic support post or a support post having a fixed vertical extension.

In accordance with yet another aspect of the present disclosure, a support post comprises:

an elongate member, a foot member arranged at the lower end of the elongate member, the foot member having an upwardly extending guide protrusion for accommodating and guiding a lower frame member of a fence panel.

In this embodiment, too, the support post may be a telescopic support post or a support post having a fixed vertical extension.

DETAILED DESCRIPTION

Figure 1:
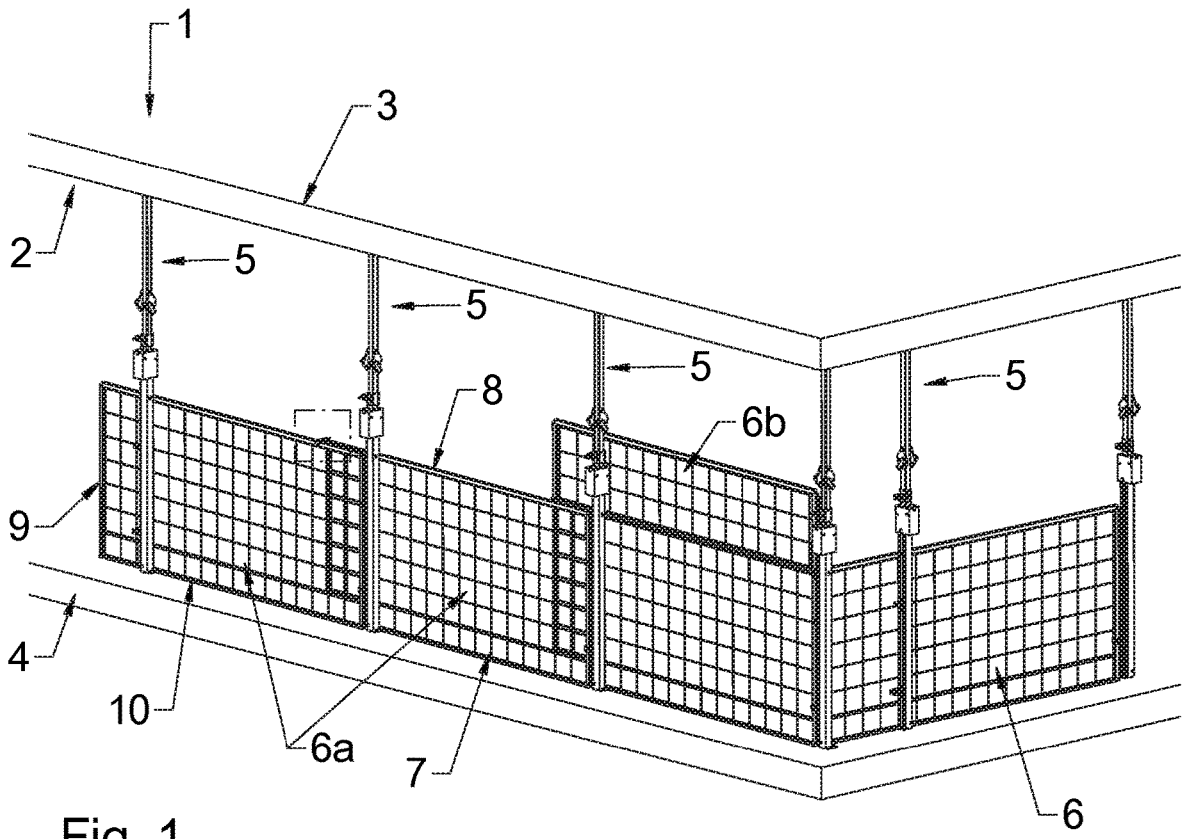
FIG. 1 is a perspective view of a temporary barrier with a plurality of support posts and fence panels for installation at a perimeter of a building under construction.
Figure 2:
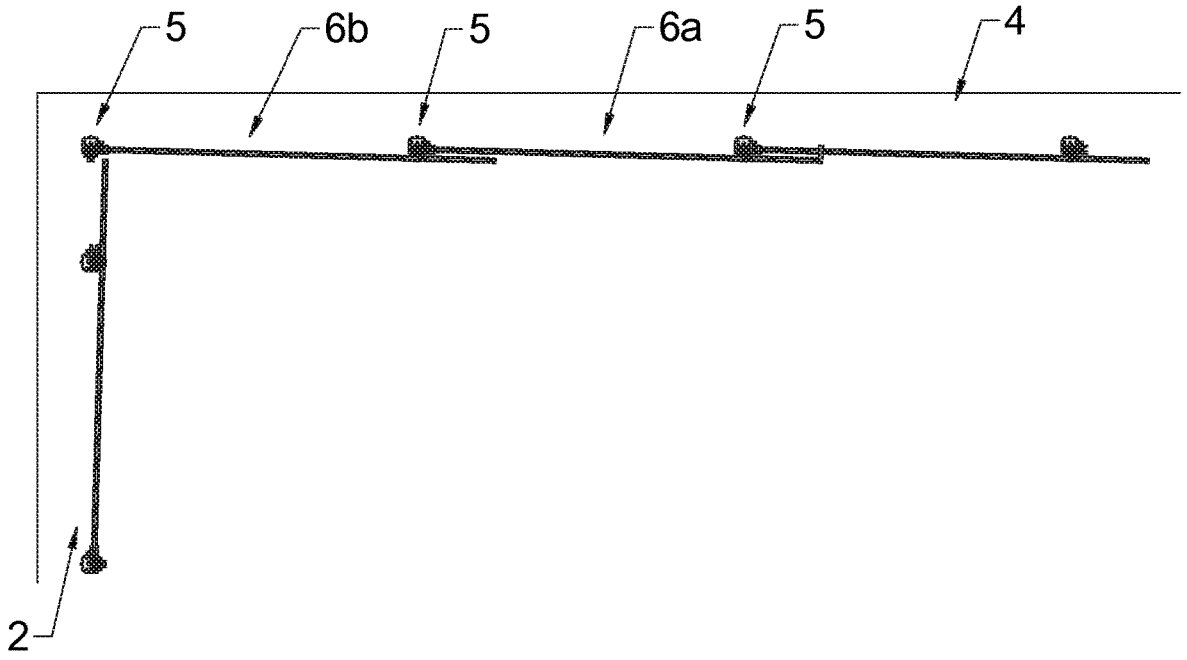
FIG. 2 is a top view of the temporary barrier of FIG. 1.
Figure 3:
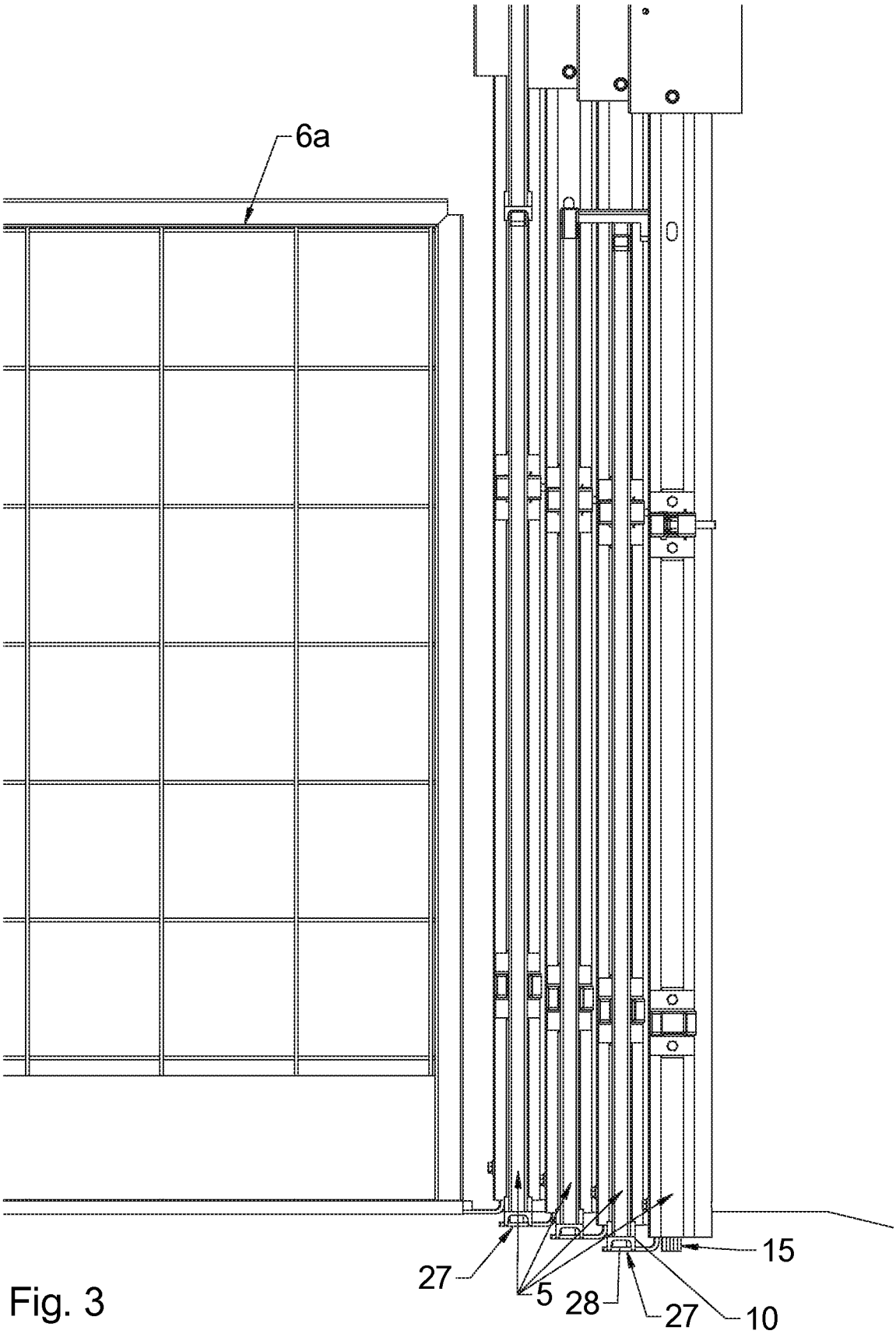
FIG. 3 is a side view of the temporary barrier of FIG. 1 and FIG. 2.

FIGS. 1 to 3 show a temporary barrier 1 for installation at a perimeter of a building 2 having a first floor 3 and a second floor 4. Temporary barrier 1 has a plurality of support posts 5 that are releasably secured between first (upper) floor 3 and second (lower) floor 4. Temporary barrier 1 further has a plurality of fence panels (barriers) 6 that are releasably attached to support posts 5. Each fence panel 6 has a rectangular frame 7 with a horizontal top frame member 8, two vertical side frame members 9 (see in detail FIG. 3) and a horizontal lower frame member 10 (see FIG. 1). In this example, within the frame of the fence panel 6 a mesh is provided.

As shown in FIG. 1, the temporary barrier 1 may have at least one lower fence panel 6*a* and at least one upper fence panel 6*b*. Upper fence panel 6*b* is placed on lower fence panel 6*a*. For this purpose, lower frame member 10 of upper fence panel 6*b* optionally has a U-shaped cross-section (not shown) for receiving top frame member 8 of lower fence panel 6*a*.

Figure 4:
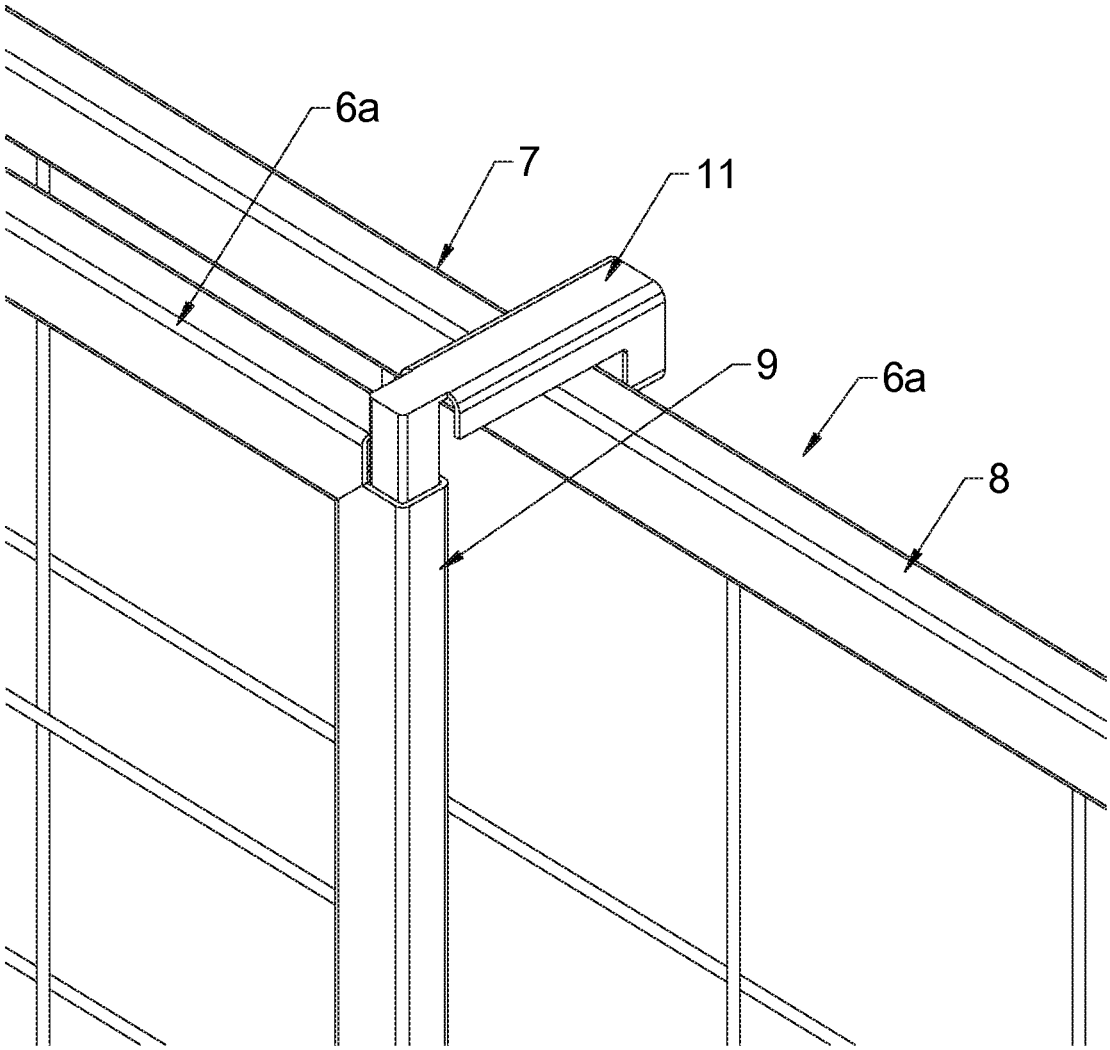
FIG. 4 is a detailed view of a connector clip between two neighboring fence panels.

As can best be seen in FIG. 4, adjacent fence panels 6, 6*a* may overlap in lateral direction (i.e. in direction of the horizontal upper or lower frame member). A releasable connector clip 11 secures two adjacent lower fence panels 6*a* to one another.

Figure 5:
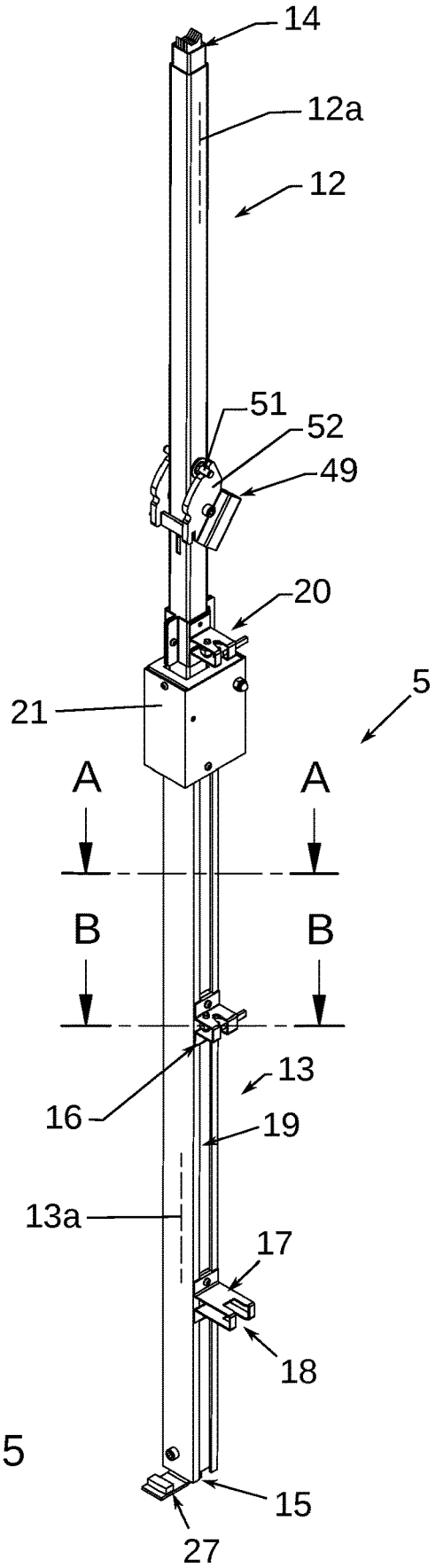
FIG. 5 is a perspective view of an embodiment of the support post used in the temporary barrier of FIGS. 1 to 3, wherein the support post has a first elongate member telescoped from a second elongate member.

As can be seen in FIG. 5, support post 5 has a first (upper) elongate member 12 and a second (lower) elongate member 13. First elongate member 12 and second elongate member 13 are telescopically connected to one another so that support post 5 can be transferred from a fully retracted state with a minimum total vertical extension to a fully extended state with a maximum total vertical extension. In the shown example, first elongate member 12 is slidably arranged inside second elongate member 13. Thus, second elongate member 13 is telescopically received about at least a portion of first elongate member 12. Support post 5 further has a first floor engaging member 14 extending upwards from an upper end of first elongate member 12 as well as a second floor engaging member 15 extending downwards from a lower end of second elongate member 13. In a secured state of support post 5 between first and second floor, first floor engaging member 14 engages first floor 3, whereas second floor engaging member 15 engages second floor 4 of building 2 to be erected.

As can be seen in FIG. 5, support post 5 further has a first latch member 16 for releasably latching one of lower fence panels 6*a* to support post 5 such that lower fence panel 6*a* is immovably connected to support post 5 in horizontal direction. In the shown example, first latch member 16 is mounted to second elongate member 13. Support post 5 further has at least one vertical guide member 17 with an opening 18 for accommodating one of side frame members 9 of lower fence panel 6*a* therein. Side frame member 9 snugly fits into opening 18 such that vertical guide member 17 restricts horizontal movement but allows for vertical movement of lower fence panel 6*a* inside opening 18. For this purpose, opening 18 of vertical guide member 17 is unobstructed so that side frame member 9 of the lower fence panel 6*a* may be freely introduced into and removed from opening 18 of guide member 17. First latch member 16 and vertical guide member 17 are releasably secured to a vertically extending guide rail 19 of support post 5. In this way, a vertical position of first latch member 16 and vertical guide member 17 at second elongate member 13 may be adjusted. Support post 5 further has a second latch member 20 for releasably latching one of upper fence panels 6*b* to support post 5 such that upper fence panel 6*b* is immovably connected to support post 5 in horizontal direction. Second latch member 20 is received about first elongate member 12 such that first elongate member 12 may slide inside second latch member 20. Thus, the vertical position of second latch member 20 is independent of the state of extension of first elongate member 12 with respect to second elongate member 13. Second latch member 20 is supported from below to remain at the same vertical position when extending or retracting first elongate member 12. In the shown example, second latch member 20 is supported by a housing 21 fixed to second elongate member 13.

Figure 6:
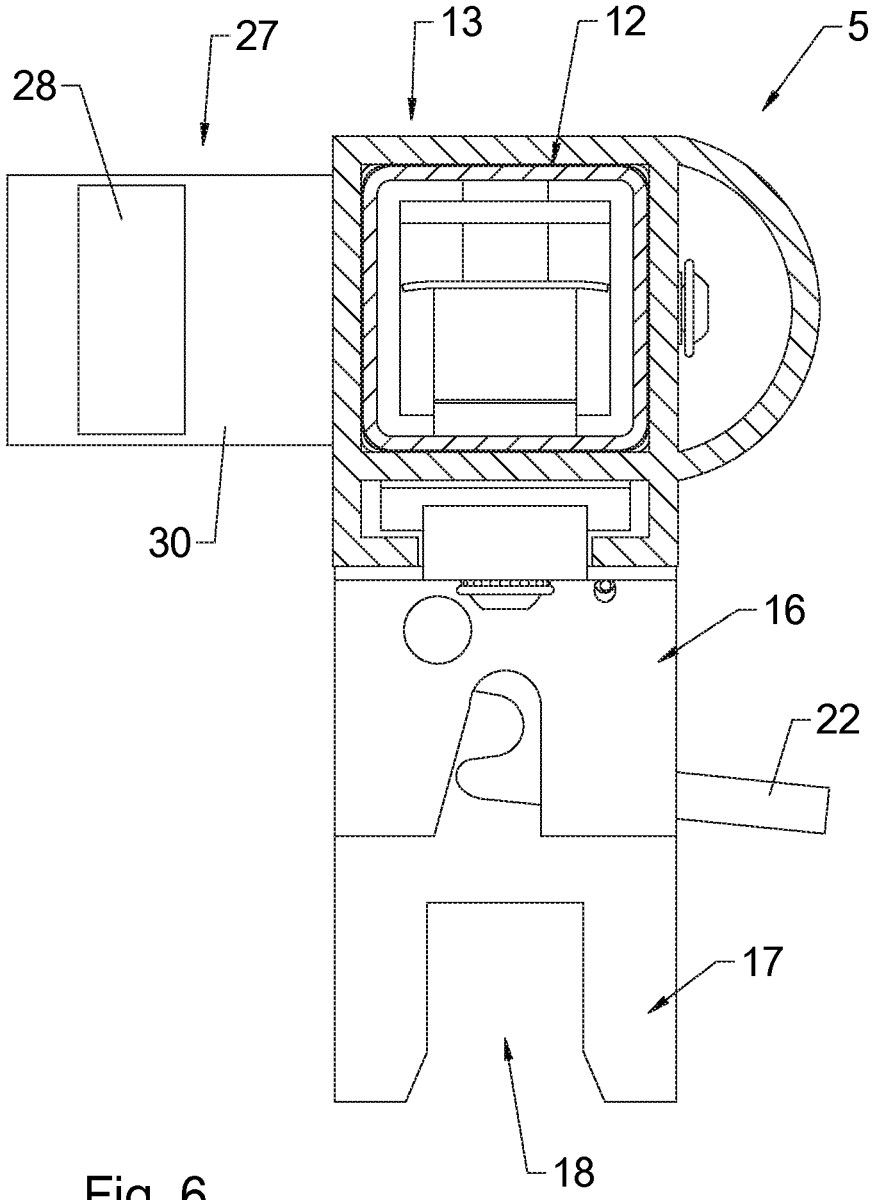
FIG. 6 is a sectional view according to lines A-A in FIG. 5.
Figure 7:
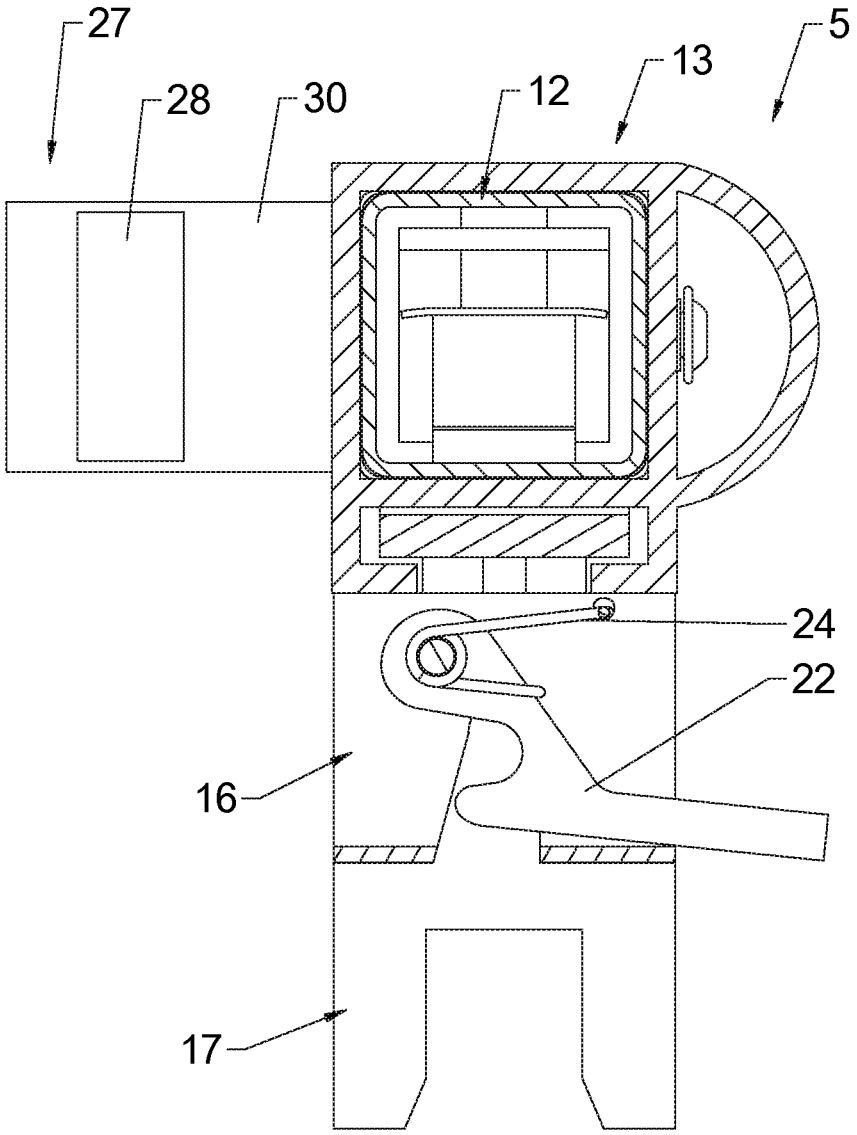
FIG. 7 is a sectional view according to lines B-B in FIG. 5.
Figure 8:
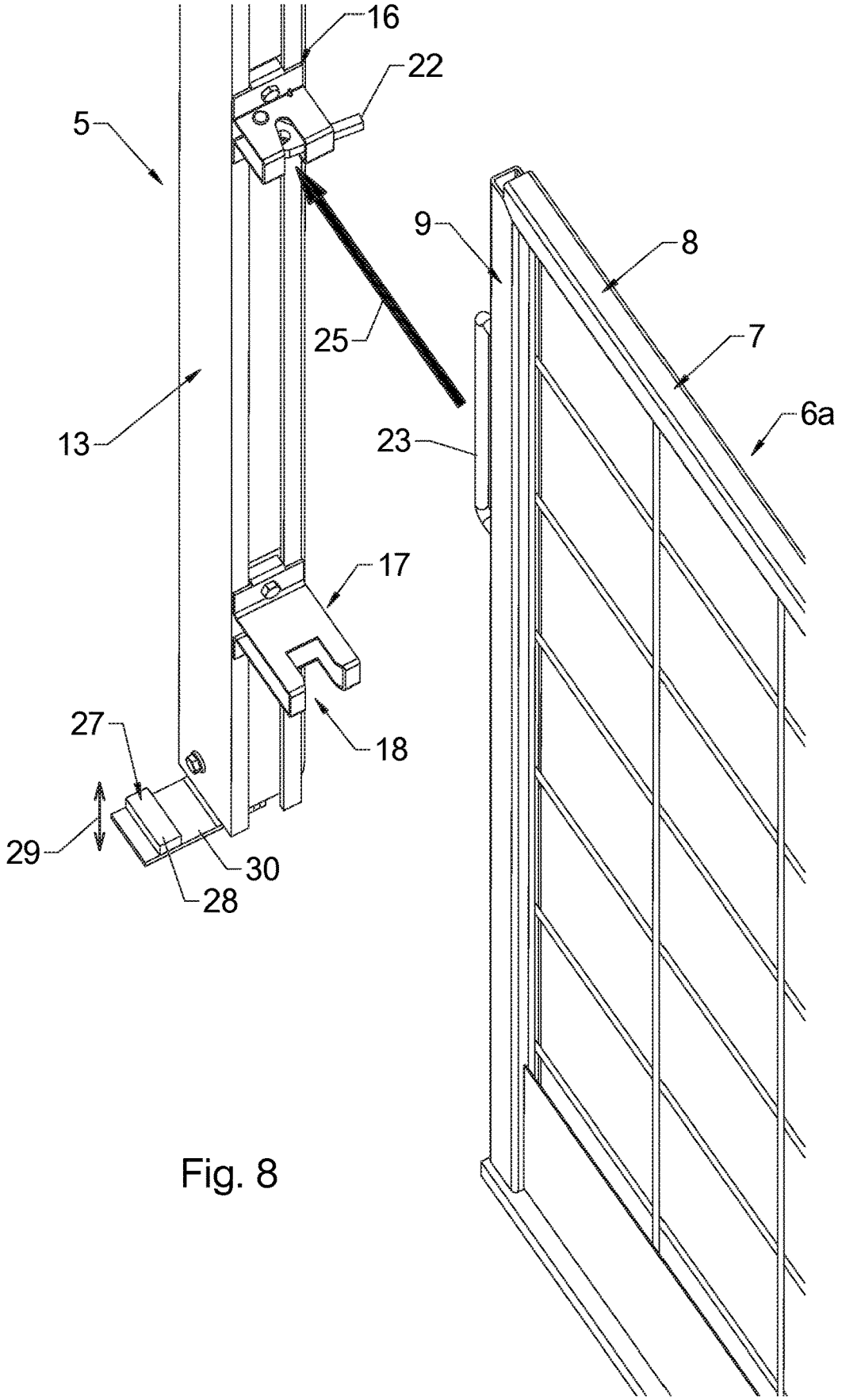
FIG. 8 shows the connection of one of the fence panels to the support post of FIG. 5.

As can be seen from the detailed views of FIG. 6, FIG. 7, FIG. 8, first latch member 16 has a latch 22 for latching a handle 23 projecting sideward from side frame member 9 of fence panel 6*a*. Latch 22 is pivotable between a locking position and a release position. A spring element 24 biases latch 22 in direction of the locking position shown in FIGS. 6 and 7. For connecting lower fence panel 6*a* to support post 5, latch 22 is temporarily pivoted backwards by means of handle 23 to allow for the insertion of handle 23 into latch member 16 (see arrow 25 in FIG. 8). Spring element 24 then urges latch 22 back into the locking position. For releasing lower fence panel 6*a*, latch 22 is manually pivoted backwards so that handle 23 can be withdrawn from latch member 16.

As can be seen from FIG. 5 (and in greater detail from FIG. 6, FIG. 7, FIG. 8, FIG. 9, FIG. 10 and FIG. 11), a foot member 27 is arranged at the lower end of second elongate member 13. Foot member 27 has an upwardly projecting guide protrusion 28 that accommodates and guides lower frame member 10 of one of lower fence panels 6*a* overlapping in horizontal direction. In the shown example, guide protrusion 28 is rectangular in cross-section seen perpendicular to the lateral movement of the lower fence panel 6*a* with respect to guide protrusion 28. When guide protrusion 28 is arranged inside lower frame member 10 of lower fence panel 6*a* (see FIG. 3), the lower end of fence panel 6*a* is guided in longitudinal direction of the lower frame member 10, while resisting a movement of the lower end of fence panel 6*a* perpendicular to a main plain of fence panel 6. As is illustrated by arrow 29 in FIG. 8, foot member 27 is height-adjustable, i.e. adjustable in direction of longitudinal axis 13*a* of second elongate member 13.

Figure 9:
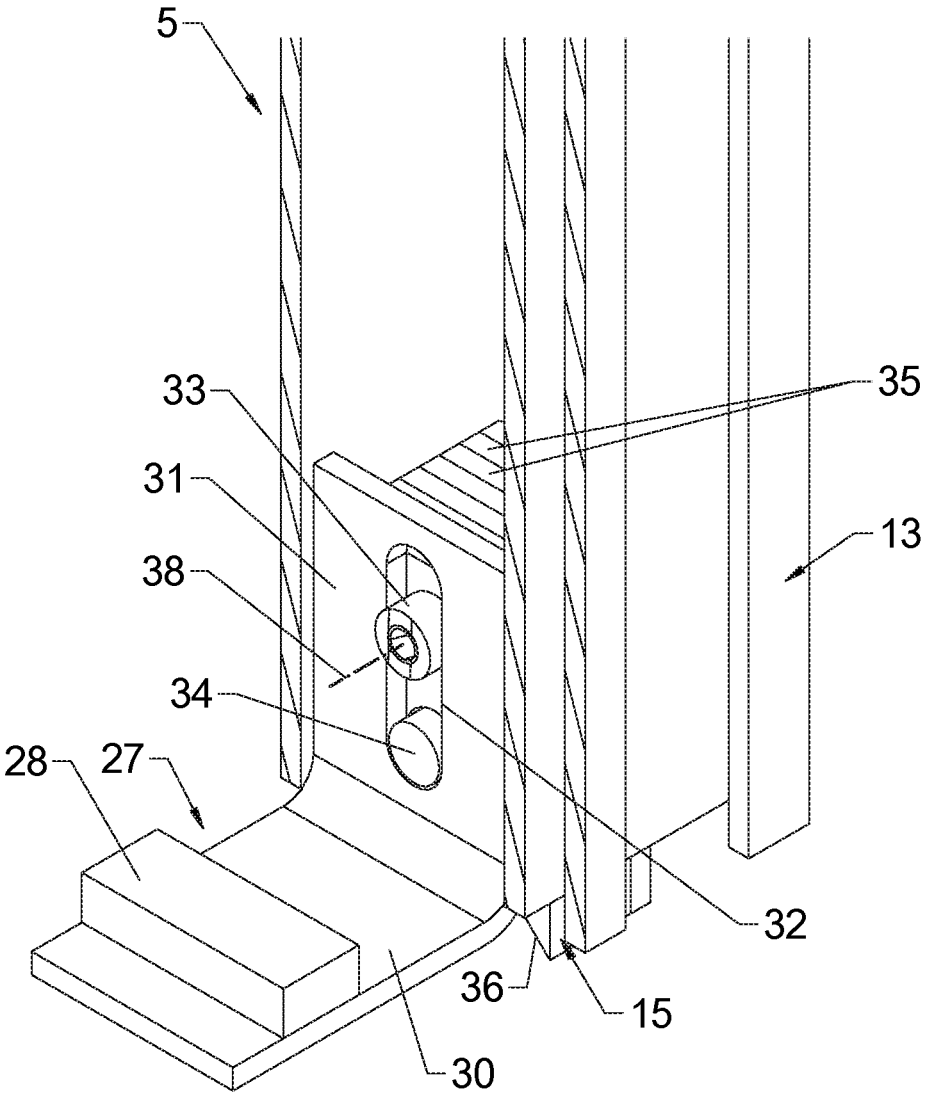
FIG. 9 is a sectional view of a lower end of the support post of FIG. 5 with a foot member arranged at an upper position.
Figure 10:
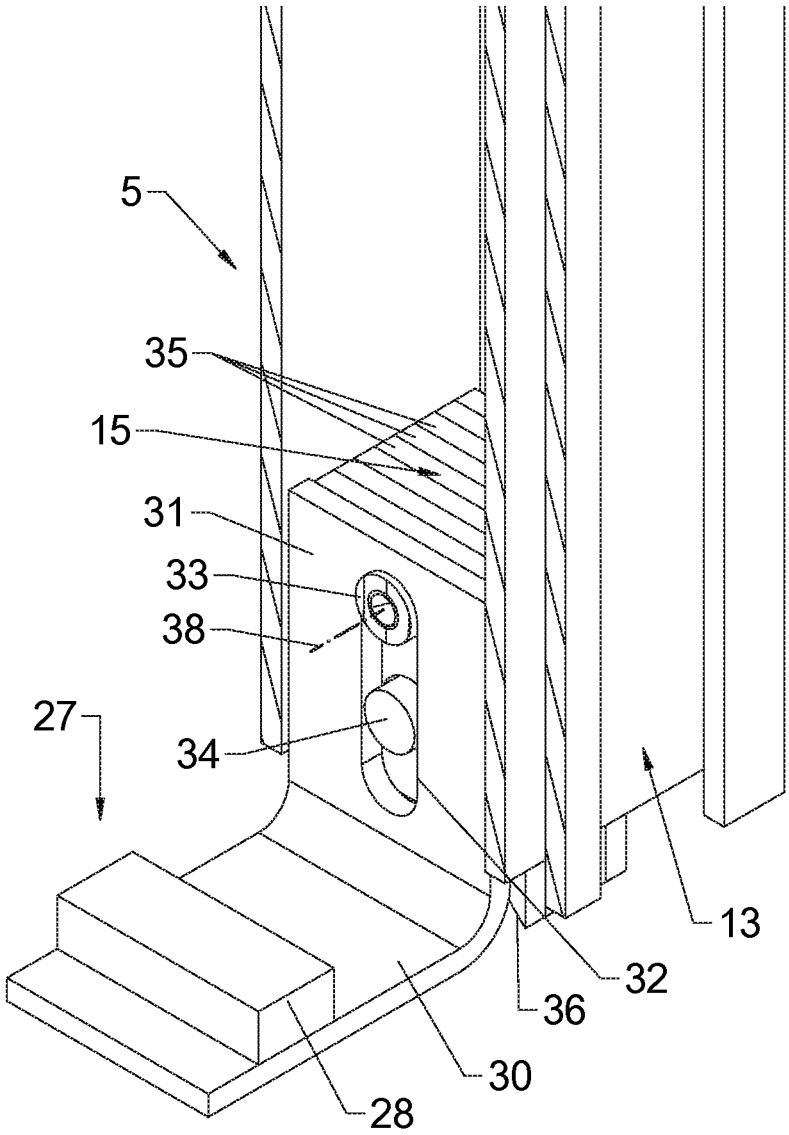
FIG. 10 is a sectional view of the lower end of the support post with the foot member arranged at a lower position.
Figure 11:
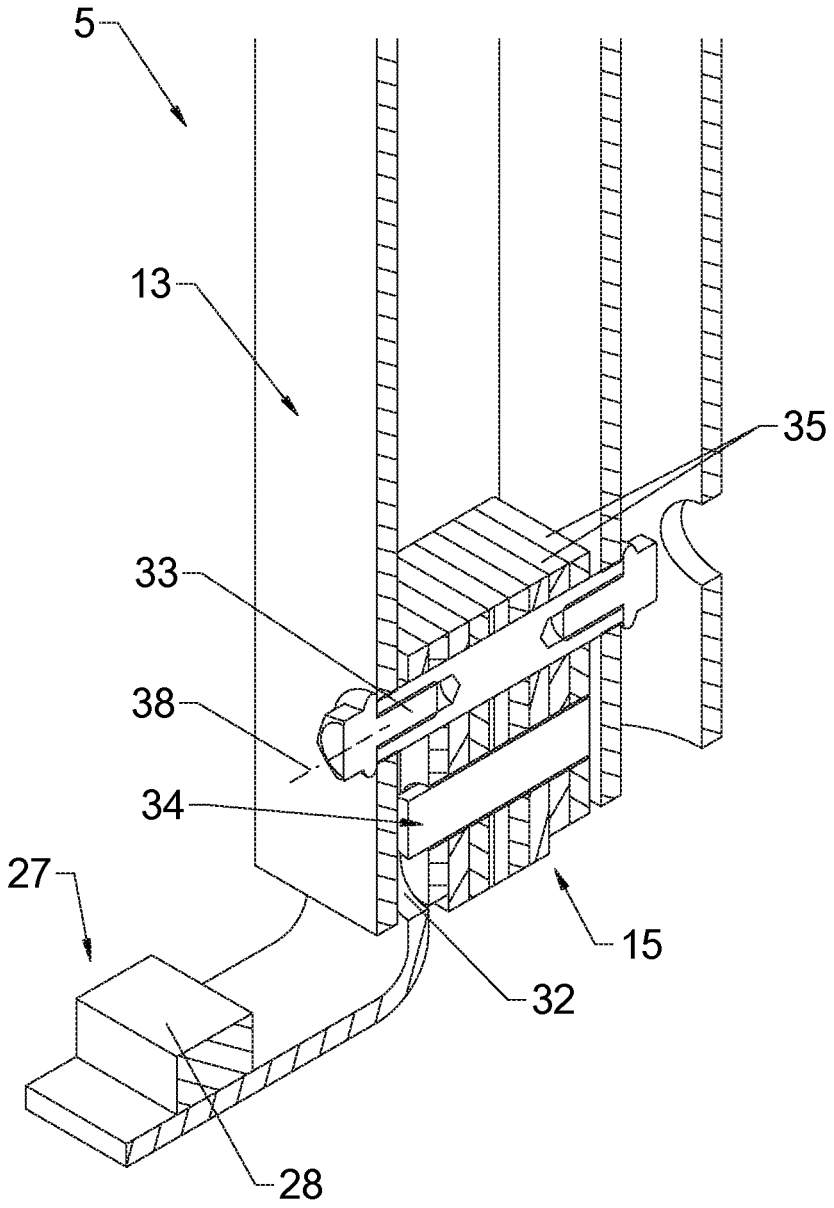
FIG. 11 is another sectional view of a lower end of the support post with a foot member arranged at a lower position.

As can best be seen in FIG. 9, FIG. 10 and FIG. 11, foot member 27 has a horizontal flange 30 supported on the second floor 4 and a vertical flange 31 slidably arranged at the lower end of second elongate member 13. Guide protrusion 28 projects upwardly from a top side of horizontal flange 30 of foot member 27. Foot member 27 has an elongate slot 32 at vertical flange 31. Elongate slot 32 extends vertically and accommodates a first pin 33 and a second pin 34 at the lower end of second elongate member 13. FIG. 9 shows an upper position of foot member 27, while FIG. 10 and FIG. 11 each show a lower position of foot member 27.

Figure 21:
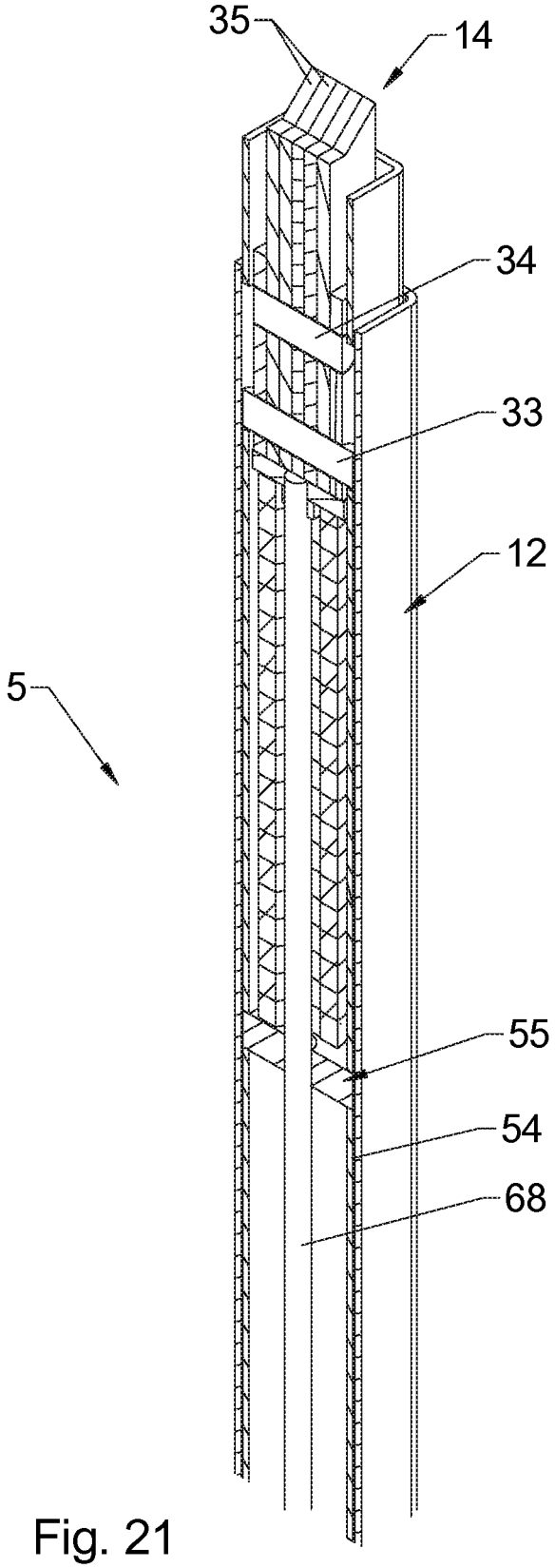
FIG. 21 is a sectional view of the support post in a loaded state of the spring (again not showing the first floor.

As can be seen from FIG. 5, FIG. 9, FIG. 10 and FIG. 11, each of the first floor engaging member 14 and the second floor engaging member 15 has a claw, which, in the shown example, comprises a plurality of clamping plates 35 arranged side by side. The following explanations of second floor engaging member 15 equally apply to first floor engaging member 14, which may be structurally identical to first floor engaging member 14 but turned upside down. At a lower end of second floor engaging member 15, clamping plates 35 have tapered surfaces 36 for engaging second floor 4. In the shown example, first floor engaging member 14 and second floor engaging member 15 each have at least three clamping plates 35 with tapered surfaces 36 for engaging first floor 3 and second floor 4, respectively. For example, each clamping plate 35 may have two spikes 37 each having one tapered surface 36 (see also FIG. 19). The two spikes 37 are formed by cut-outs in each of the clamping plates 35. Clamping plates 35 of first floor engaging member 14 and second floor engaging member 15 are each pivotally mounted on first elongate member 12 and second elongate member 13, respectively. Pivot axes 38 of clamping plates 35 extend perpendicularly to longitudinal axis 12*a* of first elongate member 12 (which is collinear with longitudinal axis 13*a* of second elongate member 13). In the shown example, pivot axis 38 is formed by a first pin 33 projecting through correspondingly shaped first through holes of clamping plates 35 (see also FIG. 21). On the other hand, second pin 34 projects through second through holes of clamping plates 35, yet with a clearance all around so that clamping plates 35 are moveable in both horizontal directions against second pin 34. In this way, clamping plates 35 may be pivoted about first pin 33 when first or second elongate member engages the first or second floor, respectively.

Figure 12:
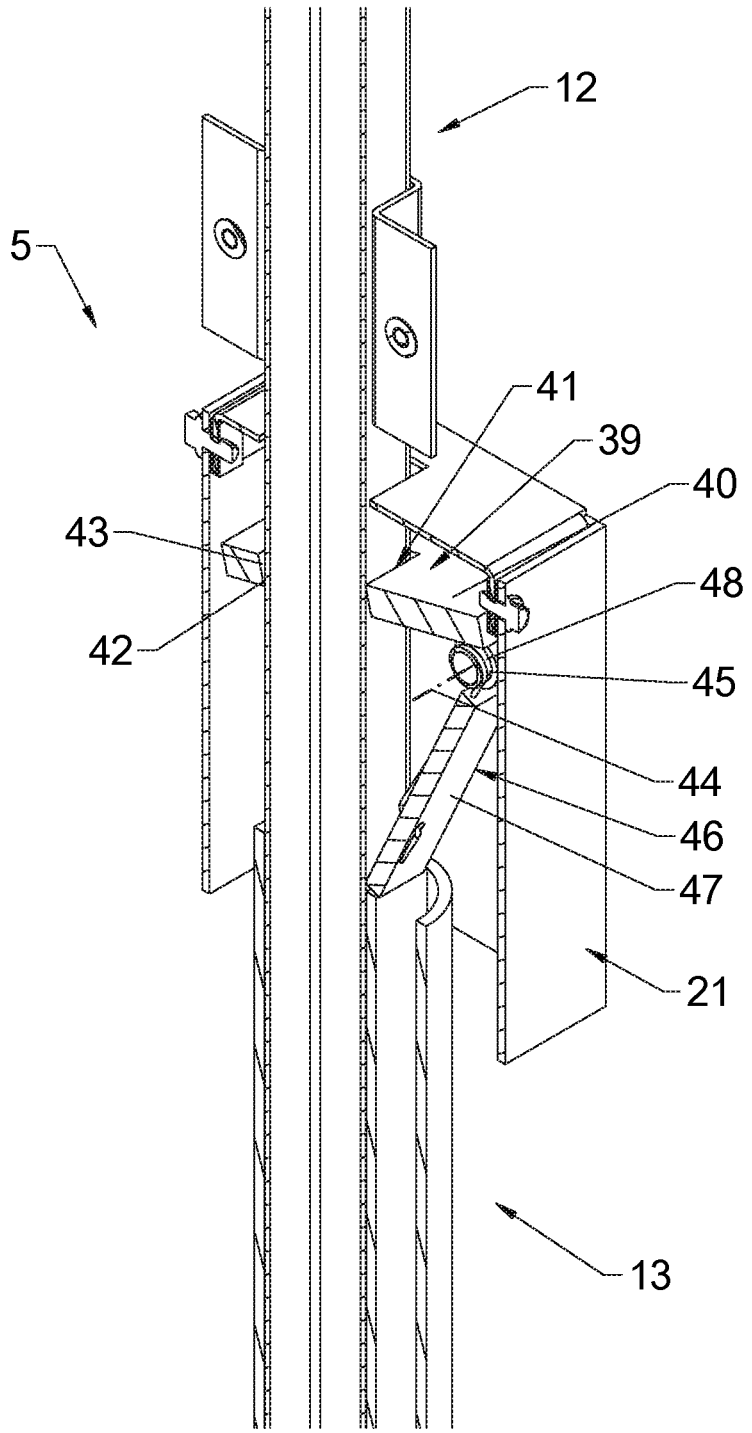
FIG. 12 is a sectional view of the support post of FIG. 5 showing a blocking member in a blocking position for blocking the retraction of the first elongate member into the second elongate member).
Figure 13:
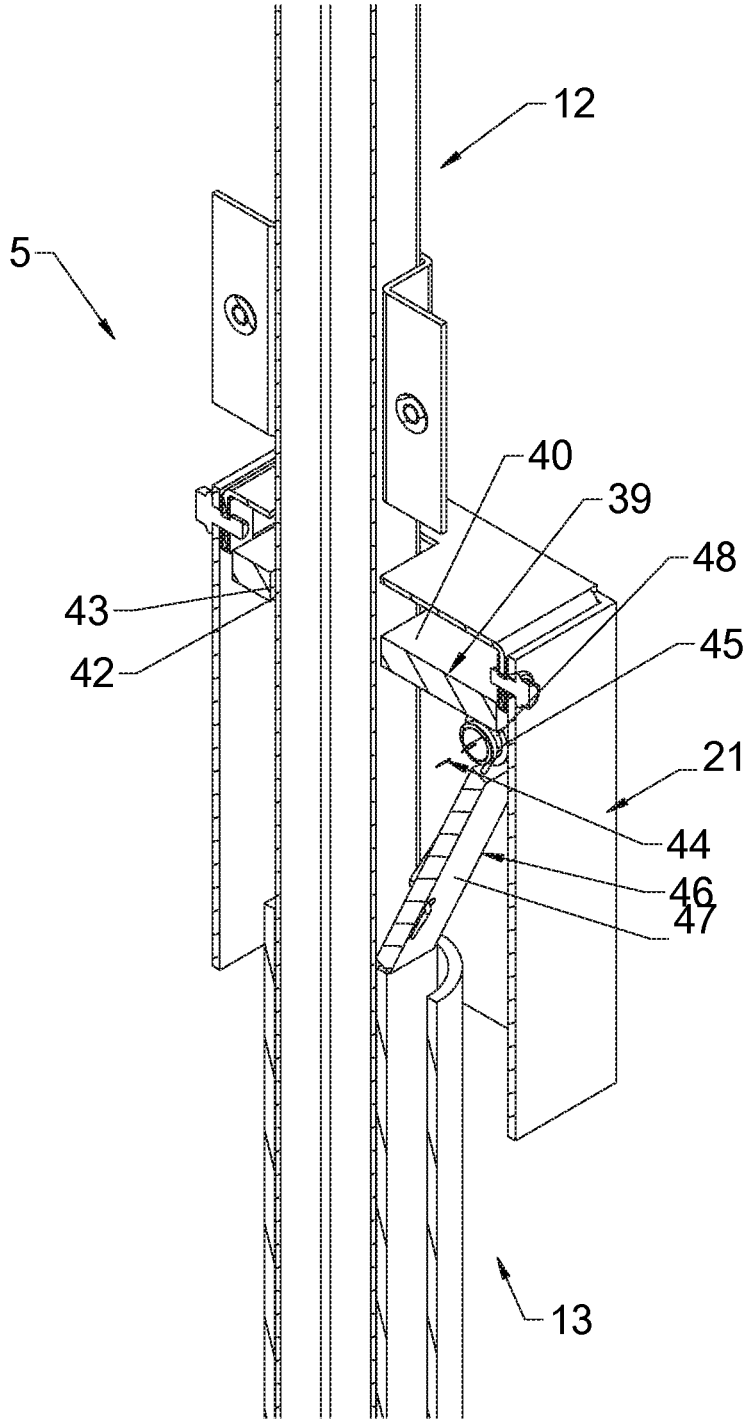
FIG. 13 is a sectional view of the support post with the blocking member in a release position.
Figure 14:
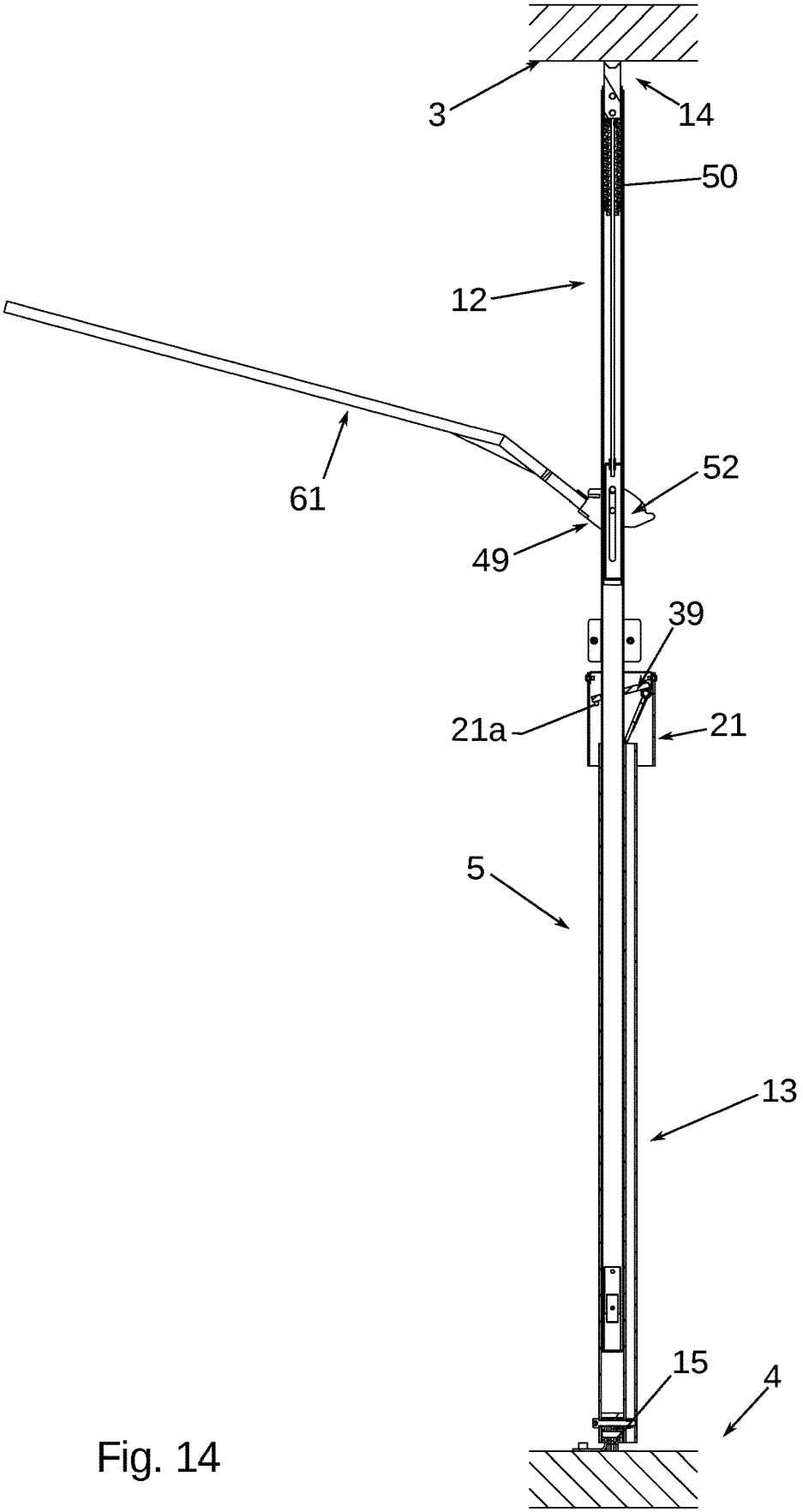
FIG. 14 is a view of the support post of FIG. 5 with a tool for vertically displacing a first floor engaging member against the force of a spring in a first position.
Figure 15:
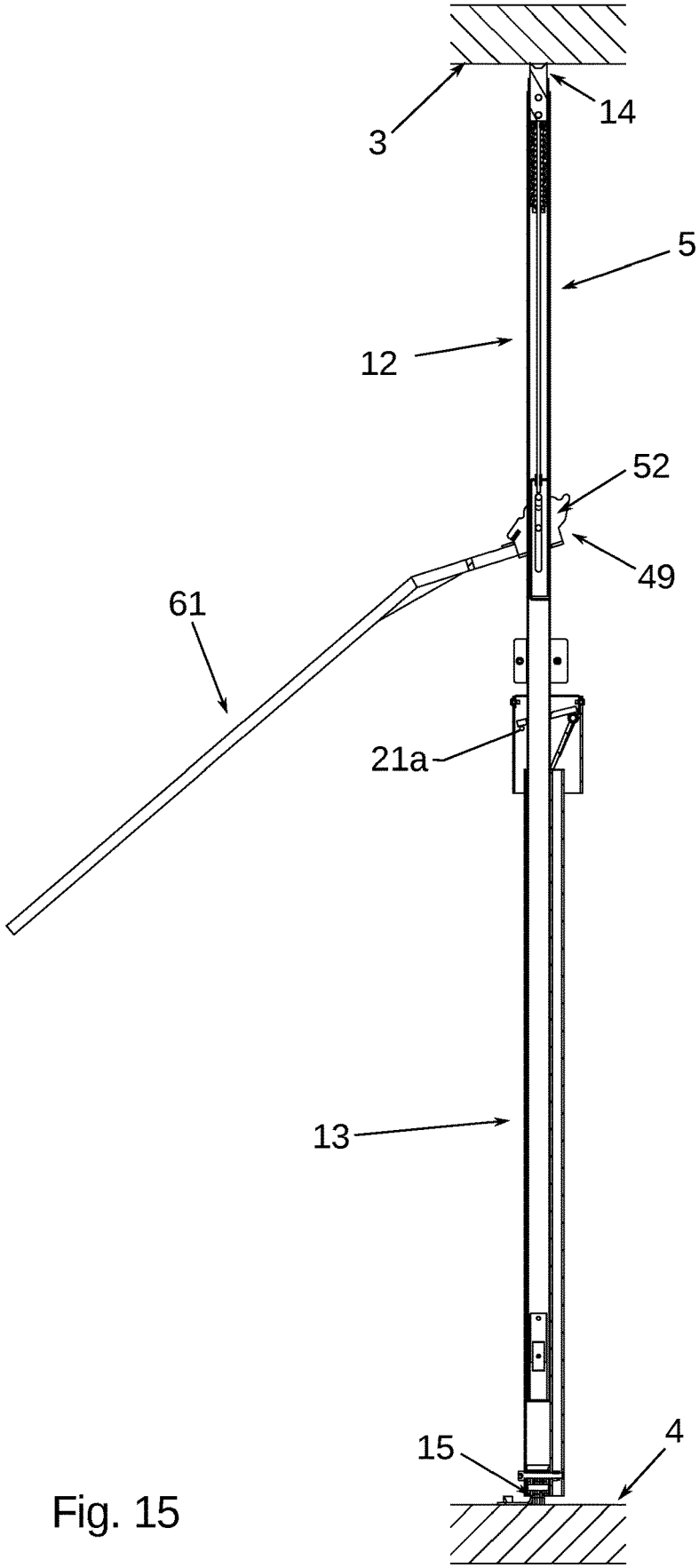
FIG. 15 is a view of the support post with the tool in an intermediary position.
Figure 16:
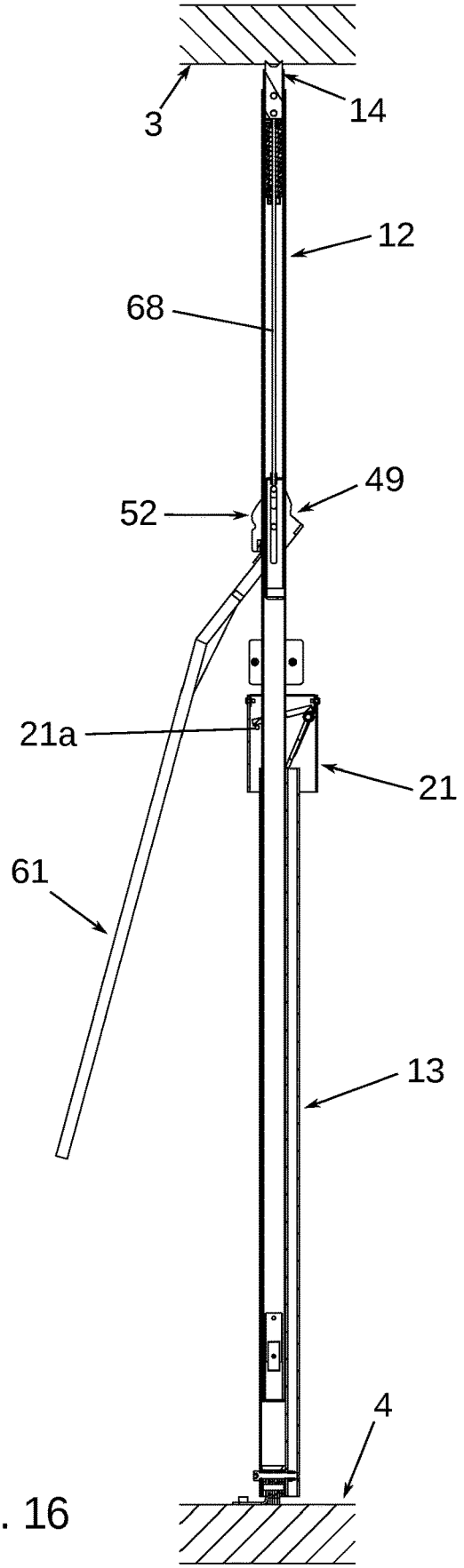
FIG. 16 is a view of the support post with the tool in a second position, in which the first floor engaging member is urged against the first floor by means of loading the spring.

As can best be seen in FIG. 12 and FIG. 13, support post 5 has a blocking member 39 for selectively blocking or releasing the telescopic movement of first elongate member 12 with respect to second elongate member 13. Blocking member 39 has a blocking plate 40 with an aperture 41 for passing first elongate member 12 therethrough. In a blocking position shown in FIG. 12, an aperture wall 42 of blocking plate 40 engages an outer wall 43 of first elongate member 12 such that first elongate member 12 is jammed inside second elongate member 13 to resist retraction of first elongate member 12 into second elongate member 13. In a release position shown in FIG. 13, aperture wall 42 of blocking plate 40 disengages outer wall 43 of first elongate member 12 so that the first elongate member 12 may be retracted into second elongate member 13. In the shown example, blocking plate 40 of blocking member 39 is pivoted between the blocking position and the release position about a pivot axis 44 extending perpendicularly to longitudinal axis 12*a* of first elongate member 12. In the blocking position, blocking plate 40 is arranged at a non-zero angle with respect to a horizontal plain. In the shown example, blocking plate 40, in the blocking position, extends downwardly in direction away from pivot axis 44, whereas blocking plate 40, in the release position, is arranged horizontally. Normally, blocking plate 40 is in the blocking position. For this purpose, a spring member 45 biases blocking plate 40 in direction of the blocking position. Spring member 45 is a torsion spring arranged about pivot axis 44. In the shown example, blocking member 39 is housed in housing 21 which is fixed to second elongate member 13. Blocking member 39 is connected to a support member 46 supported on an upper end of the second elongate member 13. Support member 46 has a support plate 47, the lower end of which abutting on the upper end of second elongate member 13. Here, support plate 47 is connected to blocking plate 40 by means of a pin 48 defining pivot axis 44. For telescoping first elongate member 12 into second elongate member 13, blocking member 39 is pivoted upwards into the release position. For this purpose, an instrument (not shown) may be introduced into an access opening 21*a* provided in the housing 21 for manipulating blocking member 39 (see FIG. 14, FIG. 15 and FIG. 16).

FIG. 14 to FIG. 25 illustrate the anchoring of support post 5 between first floor 3 and second floor 4. In a first step, the total vertical extension of support post 5 is adjusted by telescoping first elongate member 12 from second elongate member 13 until first floor engaging member 14 touches the first floor (i.e. the ceiling). As a next step, first floor engaging member 14 and second floor engaging member 15 are brought in engagement with first floor 3 and second floor 4, respectively. For this purpose, support post 5 has a displacement unit 49 for displacing first floor engaging member 14 in direction away from an upper end of first elongate member 12 (i.e. towards first floor 3). Thus, first floor engaging member 14 can be transferred from a fully retracted position to a fully extended position in an unloaded state of the first floor engaging member 14 (i.e. as long as there is no counter pressure from above on floor engaging member 14, in particular by means of first floor 3). In the shown example, displacement unit 49 has a spring 50 (see FIG. 20, FIG. 21), for example a coil spring, resisting movement of first floor engaging member 14 from the fully retracted to the fully extended position when first floor engaging member 14 comes in contact with first floor 3. For this purpose, spring 50 biases first floor engaging member 14 in a direction away from the upper and lower end of first elongate member 12 (see FIG. 14, FIG. 15, FIG. 16, FIG. 20). Thus, first floor engaging member 14 is pressed against first floor 3 by means of spring 50 when displacement unit 49 is activated.

Figure 17:
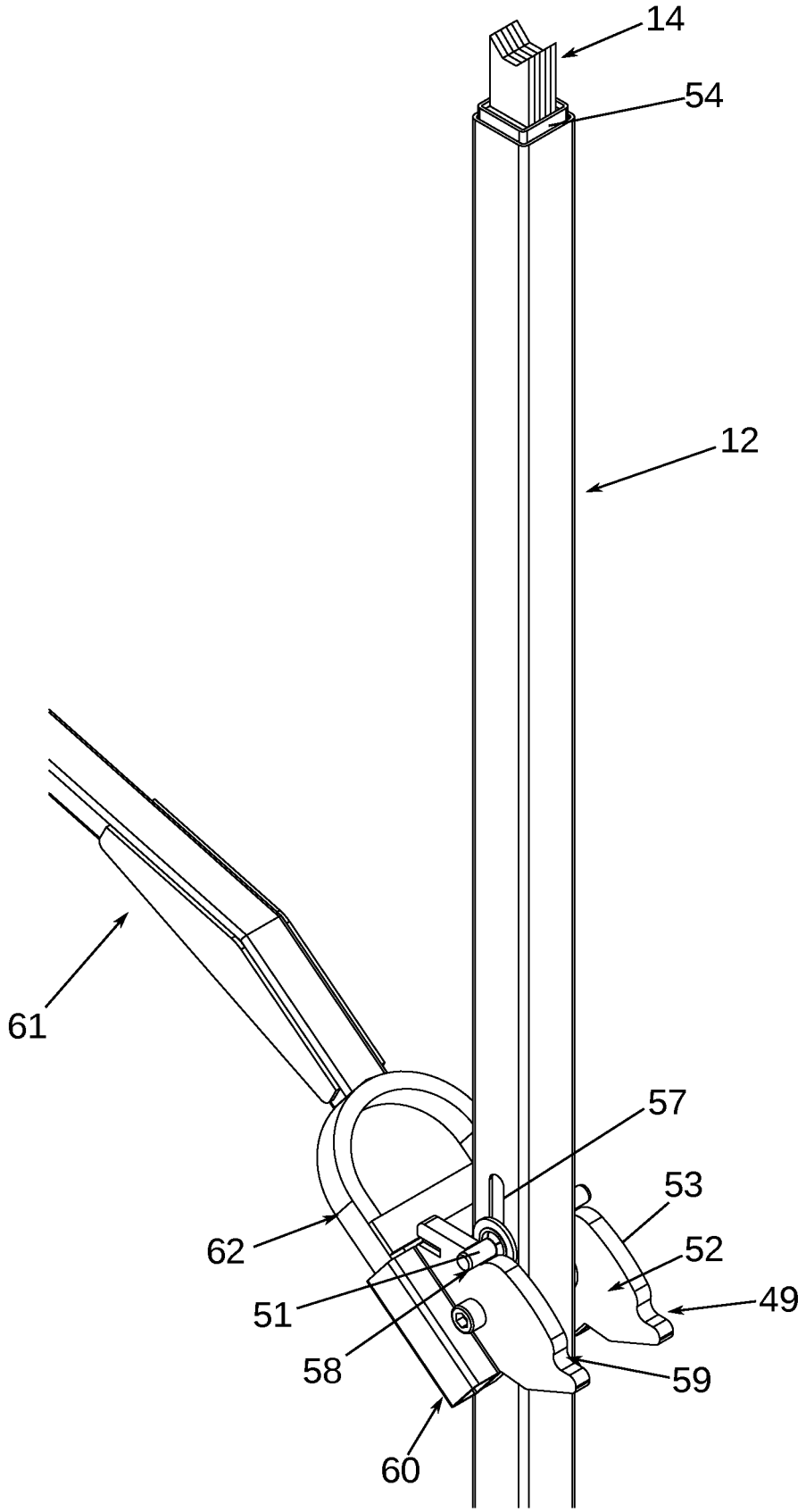
FIG. 17 is a detailed view of the support post in the first position of the tool as shown in FIG. 14 (yet not showing the first floor).
Figure 18:
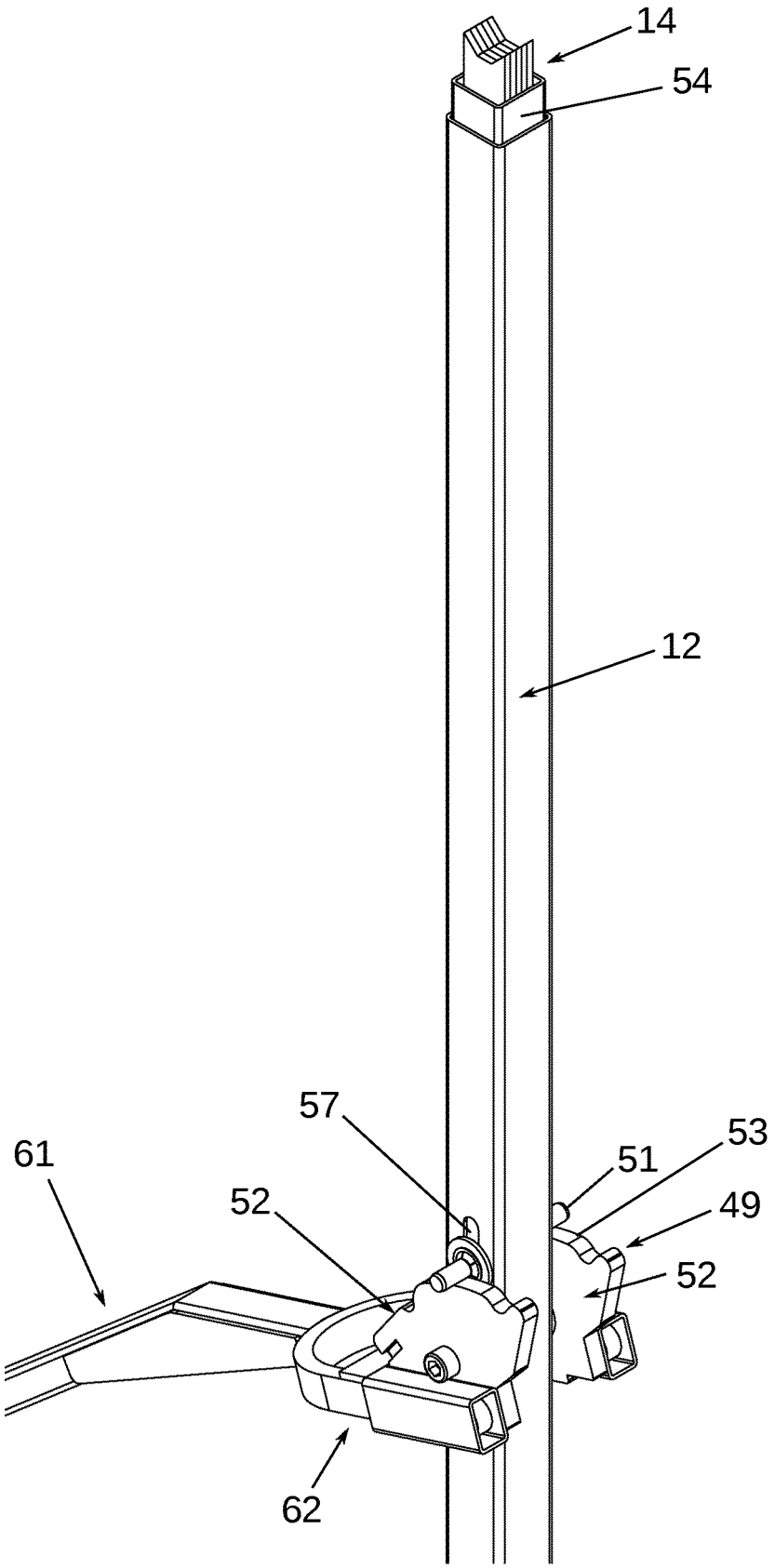
FIG. 18 is a detailed view of the support post in the intermediary position of the tool as shown in FIG. 15 (again not showing the first floor acting on the first floor engaging member).
Figure 19:
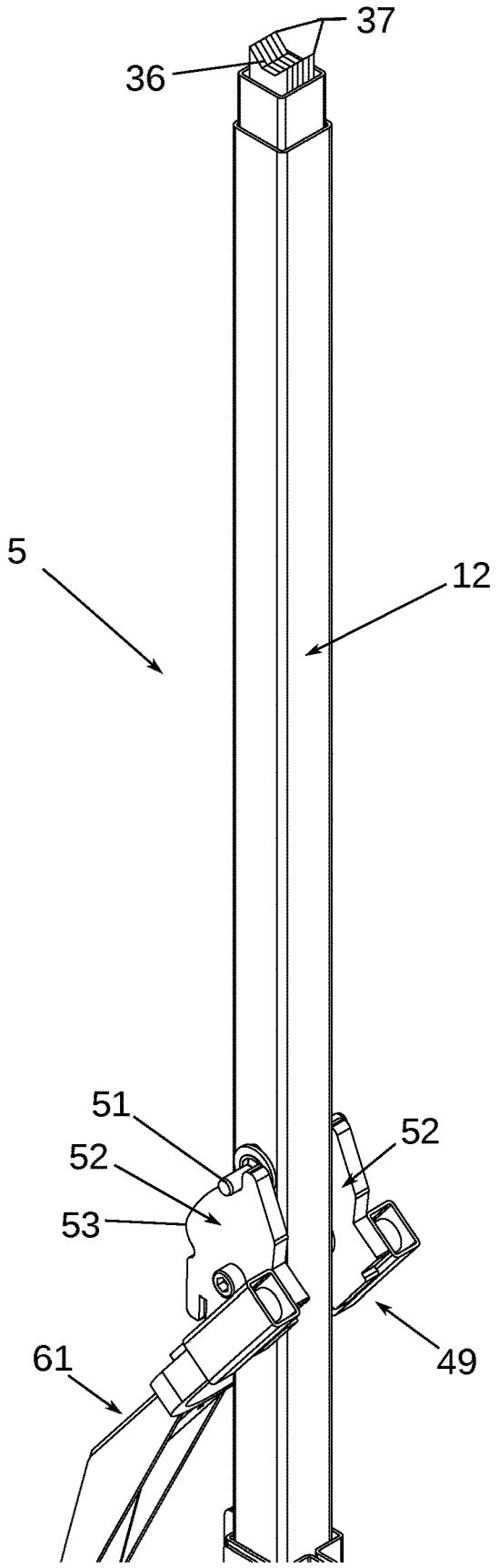
FIG. 19 is a detailed view of the support post in the second position of the tool as shown in FIG. 16 (again not showing the first floor).
Figure 20:
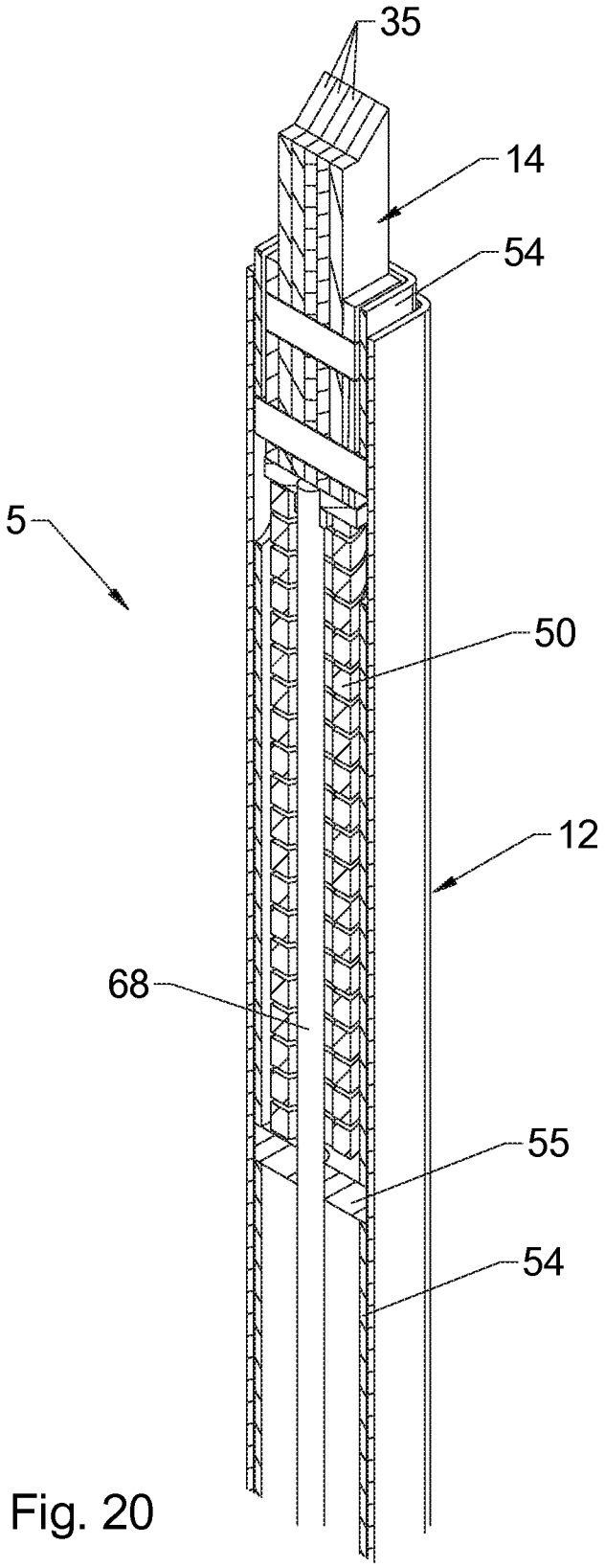
FIG. 20 is a sectional view of the support post in a relaxed state of the spring.

In the shown example, displacement unit 49 has a slide member 51, a guide member 52 with a curved surface 53 for guiding slide member 51 thereon and a hollow elongate force transfer member 54 connected to slide member 51 (see FIG. 17, FIG. 18, FIG. 19). The sliding motion of slide member 51 on curved surface 53 of guide member 52 is transferred into a linear displacement of elongate force transfer member 54. Elongate force transfer member 54 acts on a bearing 55 for a first end of spring 50 while the second end of spring 50 acts on first floor engaging member 14. When first floor engaging member 14 is pressed against first floor 3 by activating displacement unit 49, spring 50 is compressed between bearing 55 at the lower end of spring 50 and first floor engaging member 14 at the upper end of spring 50 (see FIG. 22). In the shown example, elongate force transfer member 54 extends up to the upper end of first elongate member 12. For allowing the vertical displacement of first pin 33 holding the first floor engaging member 14, elongate force transfer member 54 further has an elongate slot 54*a* accommodating first pin 33. On the other hand, elongate force transfer member 54 has an opening 54*b* for accommodating bearing 55 for spring 50 (see FIG. 25)

Figure 22:
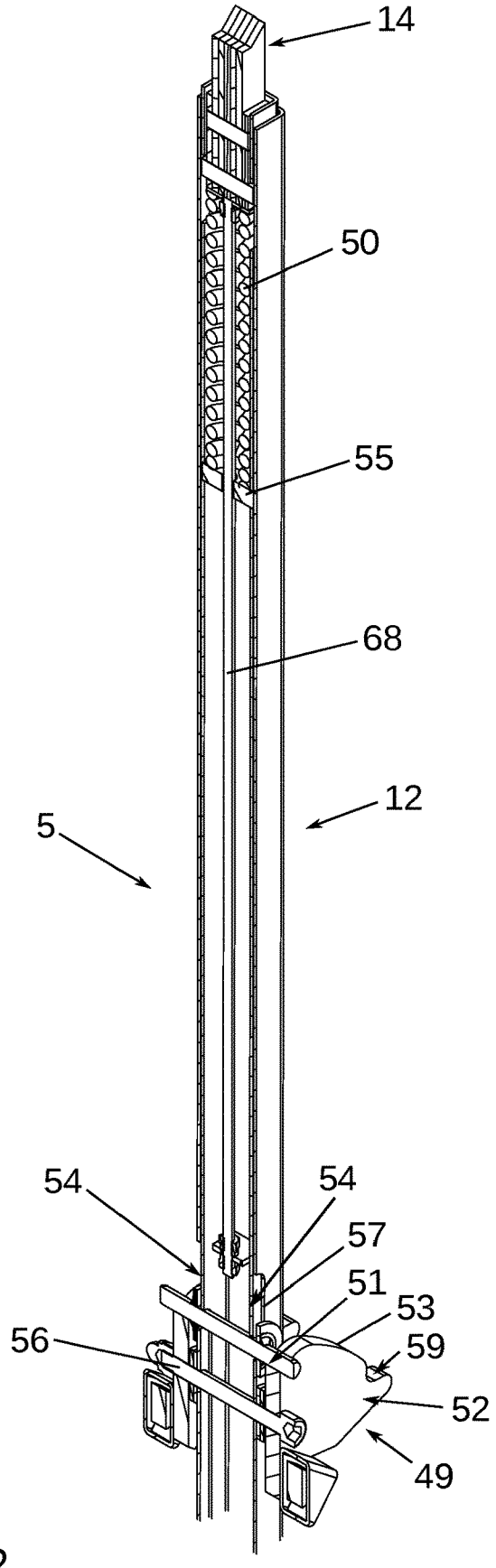
FIG. 22 is another sectional view of the support post in a relaxed state of the spring.
Figure 23:
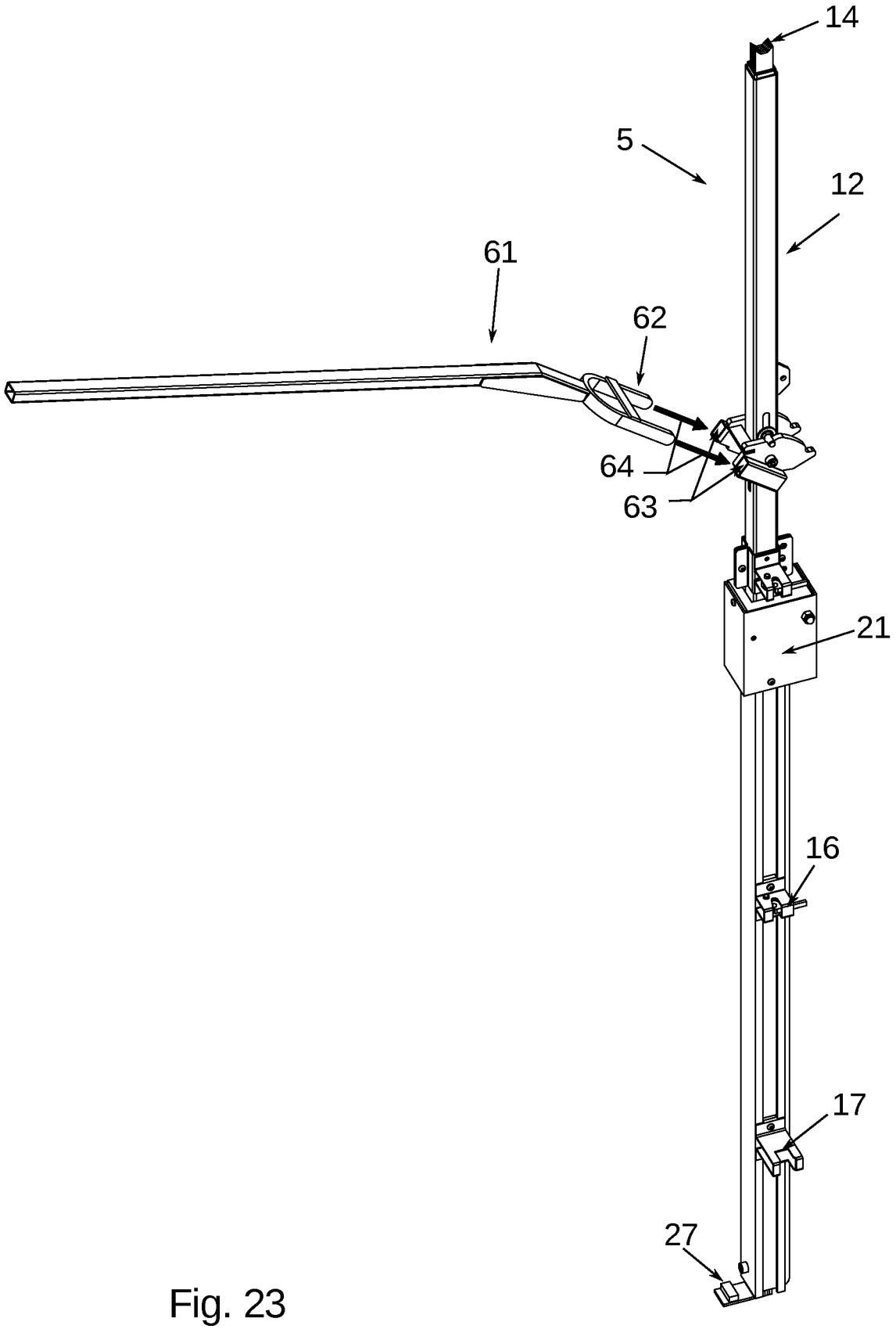
FIG. 23 shows the releasable connection of the tool to an interface of a displacement unit for the vertical displacement of the first floor engaging member.
Figure 24:
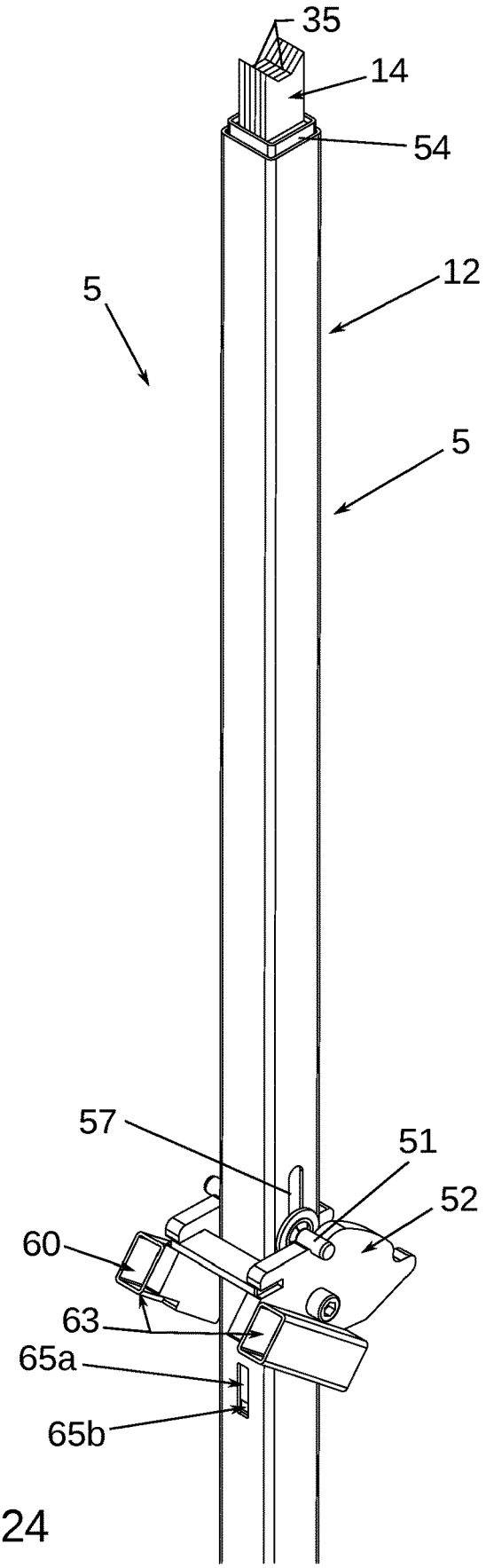
FIG. 24 is a detailed view of the support post with the tool removed from the interface of the displacement unit.
Figure 25:
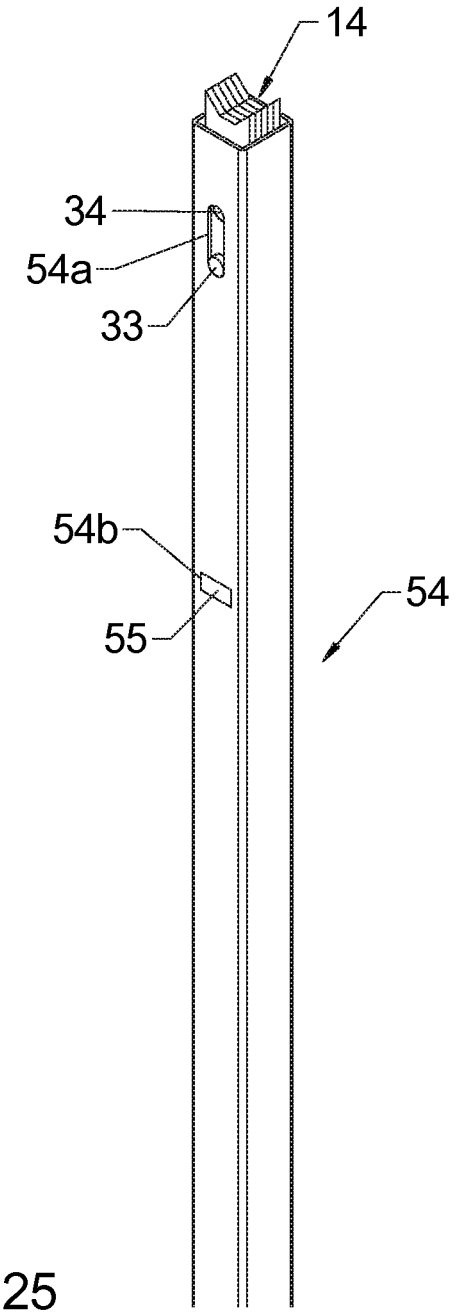
FIG. 25 is a detailed view of an elongate force transfer member of the displacement unit of the support post.

In the shown example, guide member 52 is pivoted about a transverse pivot 56 extending perpendicular to longitudinal axis 12*a* of first elongate member 12 (see FIG. 22). By pivoting guide member 52, slide member 51 is moved along curved surface 53 of guide member 52 such that slide member 51 is vertically displaced for pushing first elongate member 12 upwards or downwards, depending on the direction of rotation of guide member 52 (see FIG. 17, FIG. 18, FIG. 19). To allow for the vertical displacement of slide member 51, first elongate member 12 has elongate guides 57 for slide member 51 at opposite sides of first elongate member 12. In this way, guide member 52 may be arranged outside of first elongate member 12.

In the shown example, wherein reference is made to FIG. 17, FIG. 18 and FIG. 19, guide member 52 has a first indentation 58 at the curved surface 53 for stably accommodating slide member 51 in a first position corresponding to a fully retracted position of first floor engaging member 12 (again with respect to an unloaded state of first floor engaging member 12 without counter pressure from first floor 3). Guide member 52 further has a second indentation 59 at the curved surface 53 for stably accommodating slide member 51 in a second position corresponding to a fully extended position of first floor engaging member 14. In the shown example, displacement unit 49 has two identical guide members 52 for guiding the same slide member 51 between the first and second position.

In the shown example, displacement unit 49 has an interface 60 for releasably connecting a tool 61 to guide member 52. Here, tool 61 has a fork member 62 for insertion into two insertion openings 63 of interface 60 (see arrows 64 in FIG. 23).

Figure 26A:
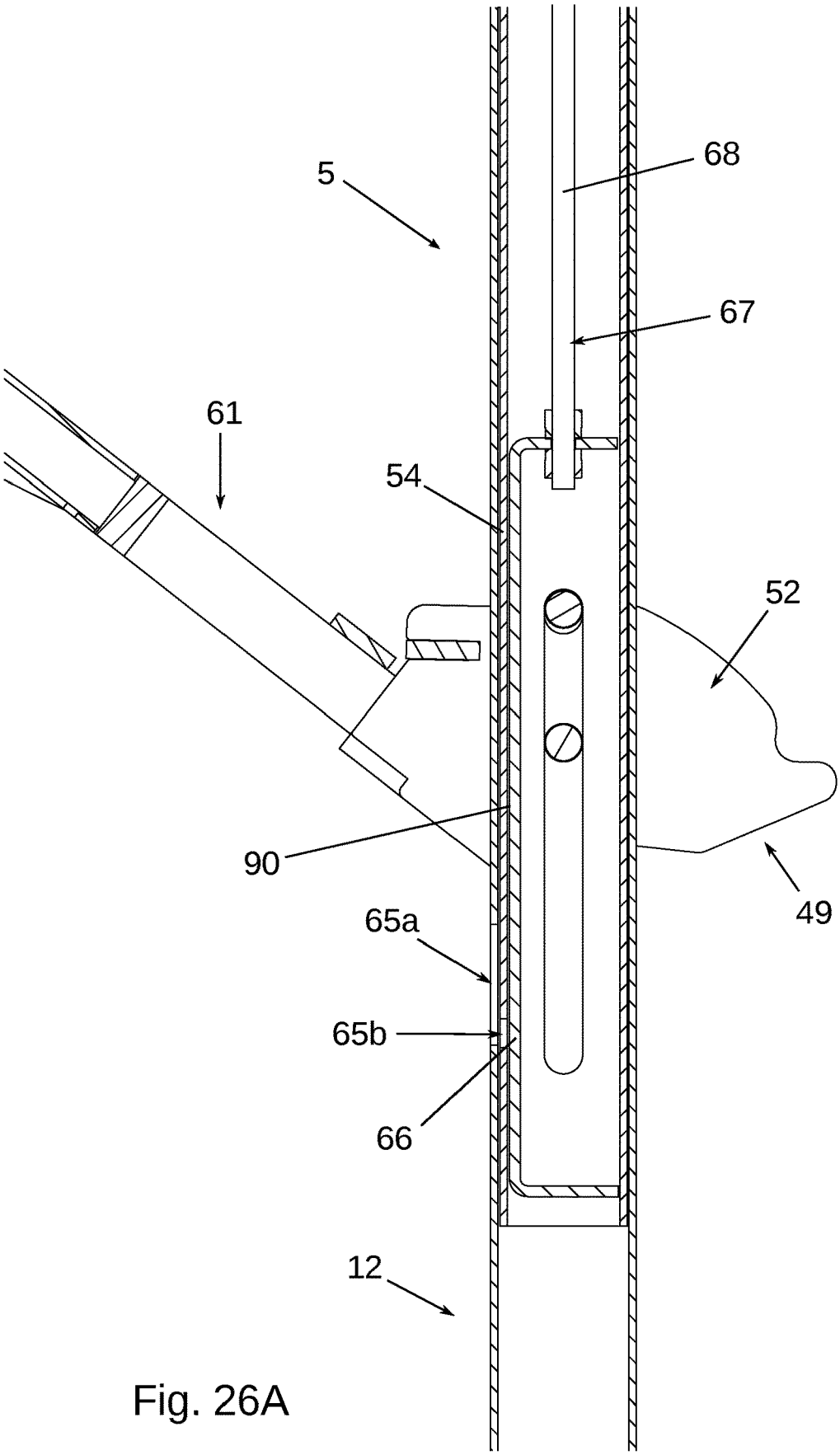
FIG. 26A is a sectional view of another embodiment of the support post in a non-tensioned state of the spring with an indicator behind an inspection window for indicating a tensioning state of the spring.
Figure 26B:
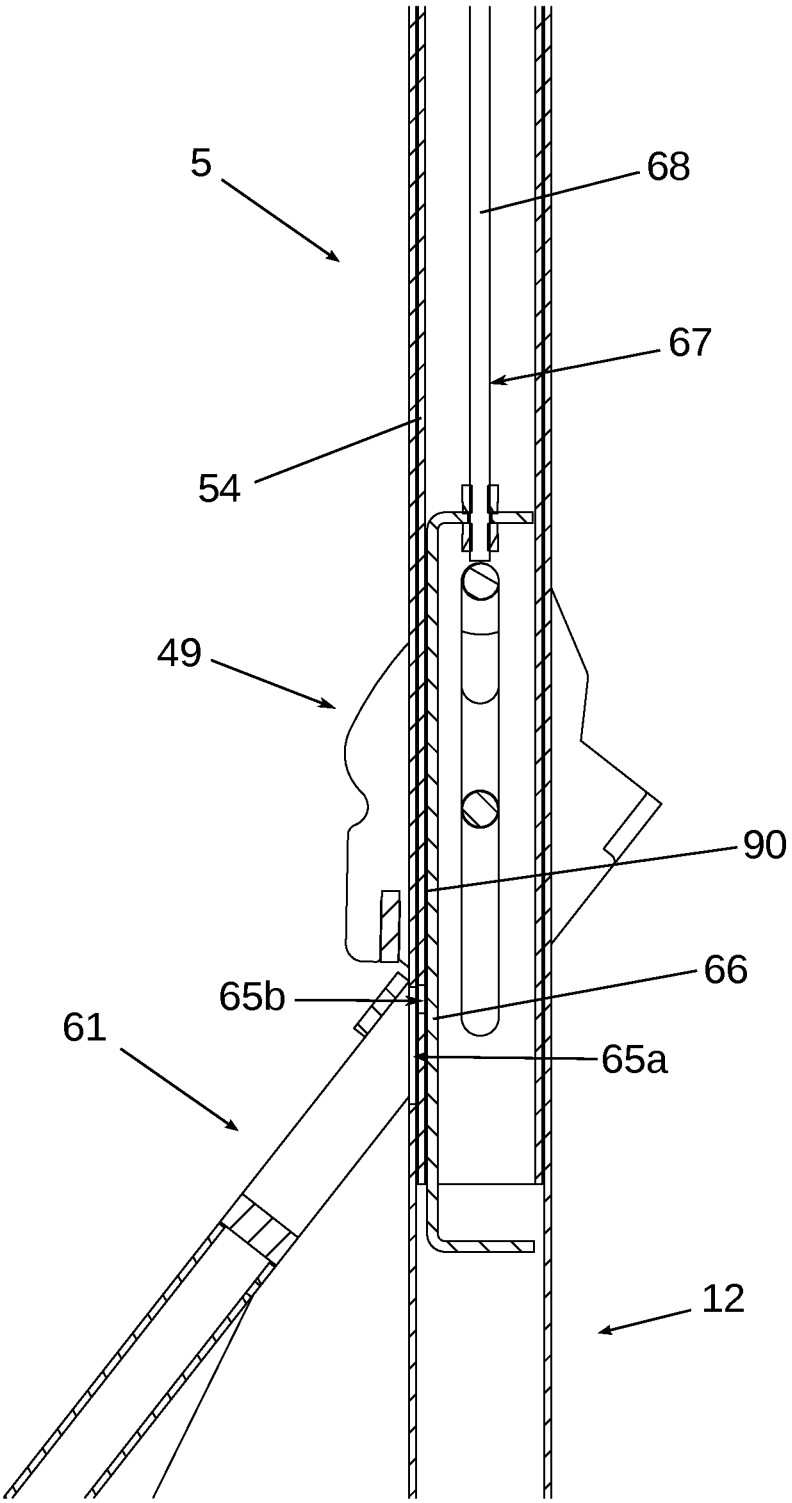
FIG. 26B is a sectional view of another embodiment of the support post in a tensioned state of the spring with an indicator behind an inspection window for indicating a tensioning state of the spring.
Figure 27:
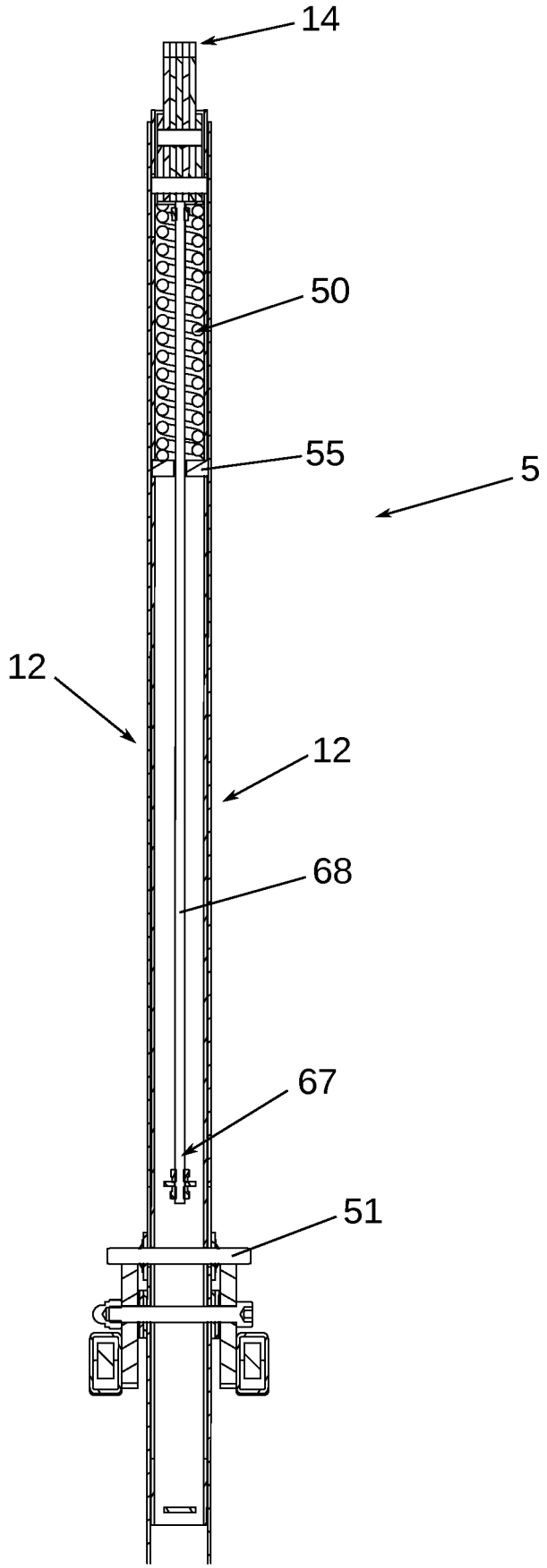
FIG. 27 is another sectional view of the support post of FIG. 26A.
Figure 33:
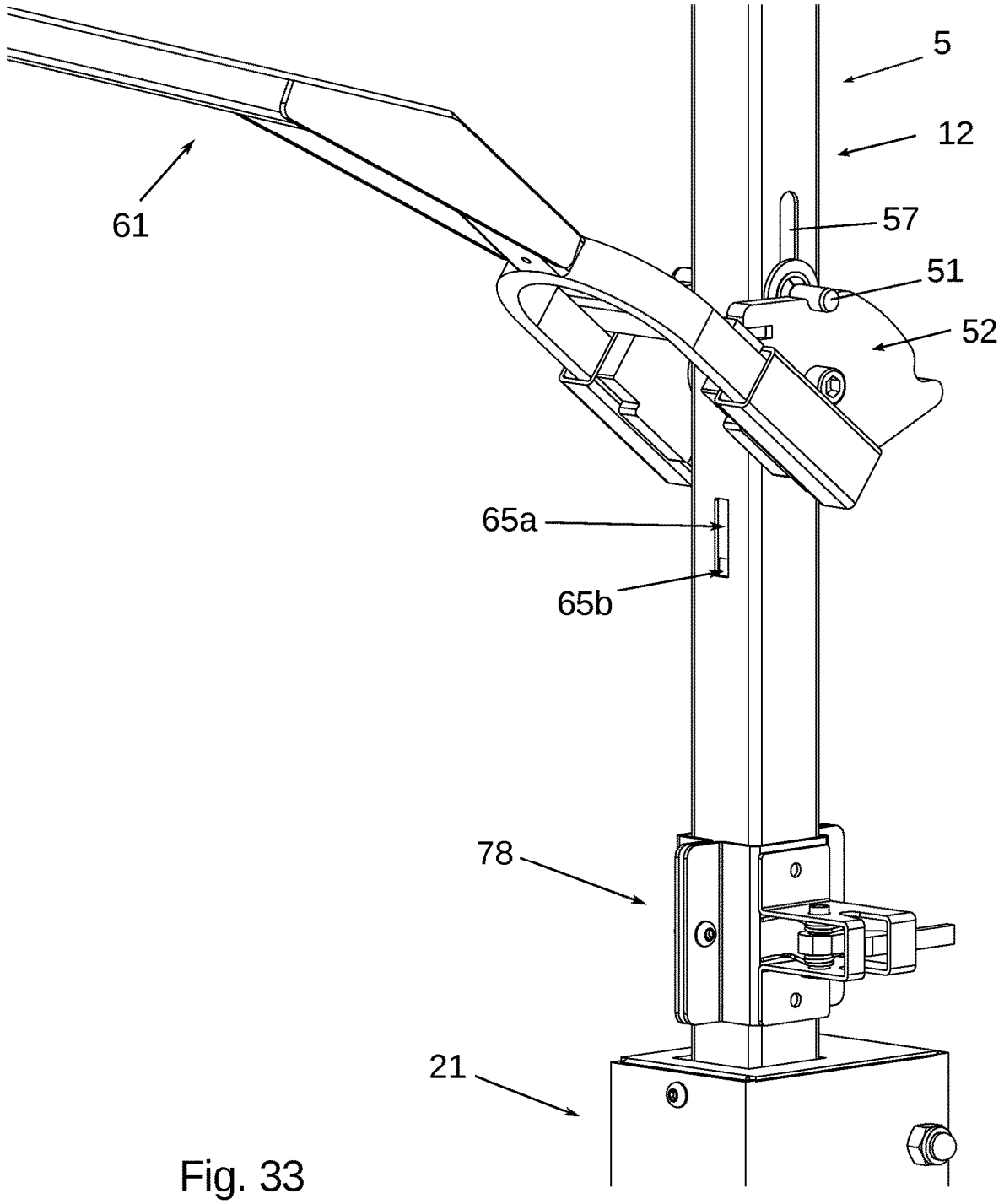
FIG. 33 is another sectional view of the support post of FIG. 28.

In the embodiment shown in FIG. 26A, 26B and FIG. 27 (see also FIG. 24 and FIG. 33), support post 5 has a first inspection window 65*a* at first elongate member 12, a second inspection window 65*b* at elongate force transfer member 54, which extends at least below the position of the first inspection window 65*a*, and an indicator 66 connected to first floor engaging member 14 via a (optionally rigid and elongate) connector 67. Advantageously, the indicator 66 is provided on a bracket member 90 attached to the connector 67. The bracket member 90 is slidable relative to and optionally floating within the elongate force transfer member 54 and the first elongate member 12. The first inspection window 65*a* has a larger vertical extension than the second inspection window 65*b*. When the displacement unit 49 is not actuated corresponding to a fully retracted position of first floor engaging member 12, i.e. when the slide member 51 is accommodated in the first indentation 58, the second inspection window 65*b* is arranged at a lower end of the first inspection window 65*a* (see FIG. 26A). When the displacement unit 49 is actuated, thus linearly displacing elongate force transfer member 54 acting on a bearing 55 for a first end of spring 50, the second inspection window 65*b* is displaced in the direction of an upper end of the first inspection window 65*a*. When the slide member 51 is accommodated in the second indentation 59, i.e. when a bearing 55 for the first end of spring 50 has reached an upmost position, the second inspection window 65*b* is arranged at the upper end of the first inspection window 65*b* (see FIG. 26B).

The linear displacement of the connector 67 can differ from the linear displacement of the force transfer member 54 and thus the linear displacement of the indicator 66 can differ from the linear displacement of the second inspection window 65*b*. In particular, their distance represents the length of the spring 50, depending on its tensioning. When the displacement unit 49 is actuated, the elongate force transfer member 54 and the bearing 55 for first end of the spring 50 will be linearly displaced by a certain distance corresponding to the linear displacement of first pin 33. If the first floor engaging member 14 was already in contact with the first floor 3, the first floor engaging member 14 will be linearly displaced only by a very short distance, in particular by a shorter distance than the bearing 55, e.g. by 1 to 2 mm, since it is pressed against (and advantageously slightly into) the first floor 3. In this case, also the connector 67 and the indicator 66 will only move by this short distance and the spring 50 will be properly tensioned. If, on the other hand, the first floor engaging member 14 was not in contact with the first floor 3 when the displacement unit 49 is actuated, the first floor engaging member 14 and with it the connector 67 and the indicator 66 will move by a longer distance than if it were in engaging contact and spring 50 will not be properly tensioned. In particular, if the first floor engaging member 14 does not come into contact with the first floor 3 at all, the indicator 66 will move by substantially the same distance as the bearing 55. If the first floor engaging member 14 was in close proximity to the first floor 3 but not in proper contact with the first floor 3 before the displacement unit 49 is actuated, the indicator 66 will be linearly displaced by a shorter distance than the bearing 55 is displaced on actuating the displacement unit 49, but by a longer distance than if the first floor engaging member 14 had been in proper contact with the first floor 3.

Indicator 66 has a first marking and a second marking spaced in vertical direction from one another and arranged such that the first marking is visible through the first inspection window 65*a* and the second inspection window 65*b* when the bearing 55 for the first end of spring 50 is not at an upmost position (i.e. the slide member 51 is accommodated in the first indentation 58) or when the bearing 55 for the first end of spring 50 is at an upmost position (i.e. the slide member 51 is accommodated in the second indentation 59) and the spring 50 is in a relaxed or not properly tensioned state and the second marking is visible through the first inspection window 65*a* and the second inspection window 65*b* when the bearing 55 for the first end of spring 50 is at an upmost position (i.e. the slide member 51 is accommodated in the second indentation 59) and the spring 50 is in a properly tensioned state. This corresponds to the first and the second marking being arranged such that the first marking is at the second inspection window 65*b* in a relaxed state of the spring 50 and the second marking is at the second inspection window 65*b* in a loaded state of the spring 50. If actuation of guide member 52 results in a full extension of first floor engaging member 14 this is indicative of insufficient tensioning of support post 5 between first floor 3 and second floor 4. Thus, first marking, which may be of red color, will be visible through the second inspection window 65*b*. However, if support post 5 is properly installed, first floor engaging member 14 bites into first floor 3 when driving guide member 52 of displacement unit 49. In this case, first floor engaging member 14 and thus indicator 66 travels only by a shorter vertical distance (or remains at the same vertical position) while spring 50 is compressed. This places second marking, which may have a green color, at a vertical location in proximity of the upper end of the first inspection window 65*a* to indicate sufficient tensioning of support post 5, wherein the second marking will be visible when the second inspection window 65*b* was linearly displaced to the upper end of the first inspection window 65*a* and at the same time the indicator 66 has not travelled at all or only by a very small distance. In the shown example, connector 67 between indicator 66 and first floor engaging member 14 has a rod 68 with a lower end attached to indicator 66 or to a bracket member 90 comprising the indicator 66, respectively, and an upper end attached to first floor engaging member 14. Rod 68 projects through bearing 55 and spring 50 and attaches to the underside of first floor engaging member 14 (see FIG. 27).

Figure 28:
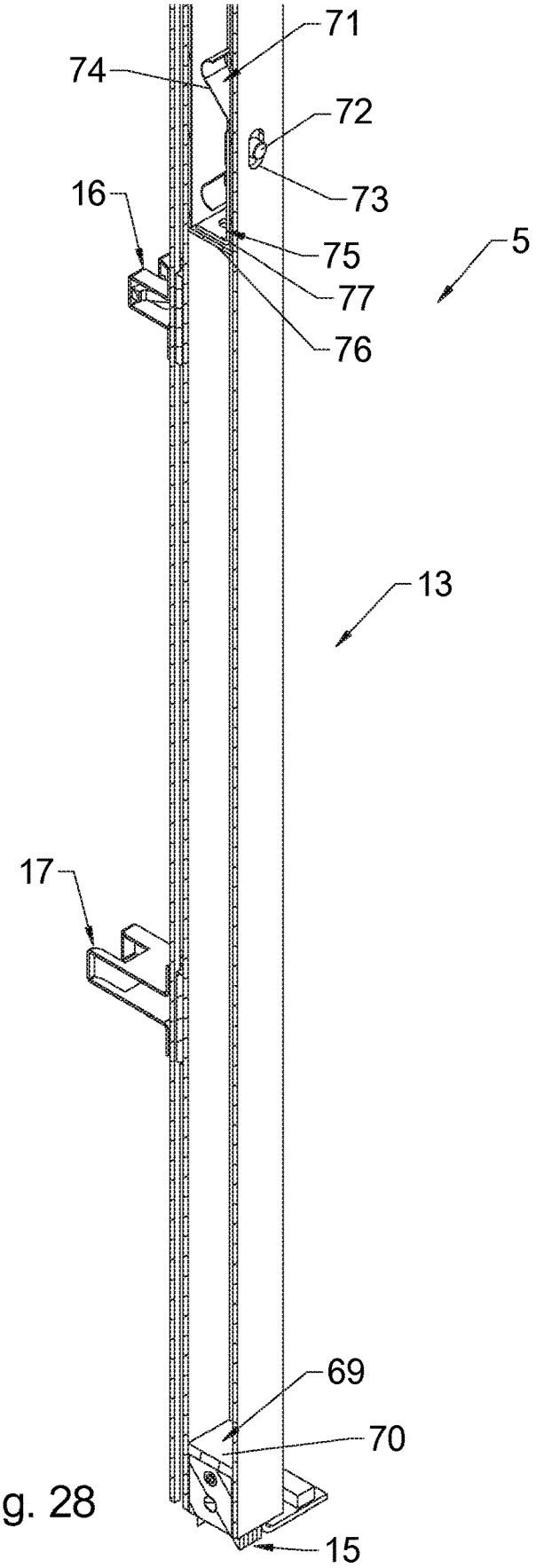
FIG. 28 is a sectional view of another embodiment of the support post with a safety device preventing the first and second elongate member from being disconnected from one another, wherein the support post is shown in a fully extended state.
Figure 29:
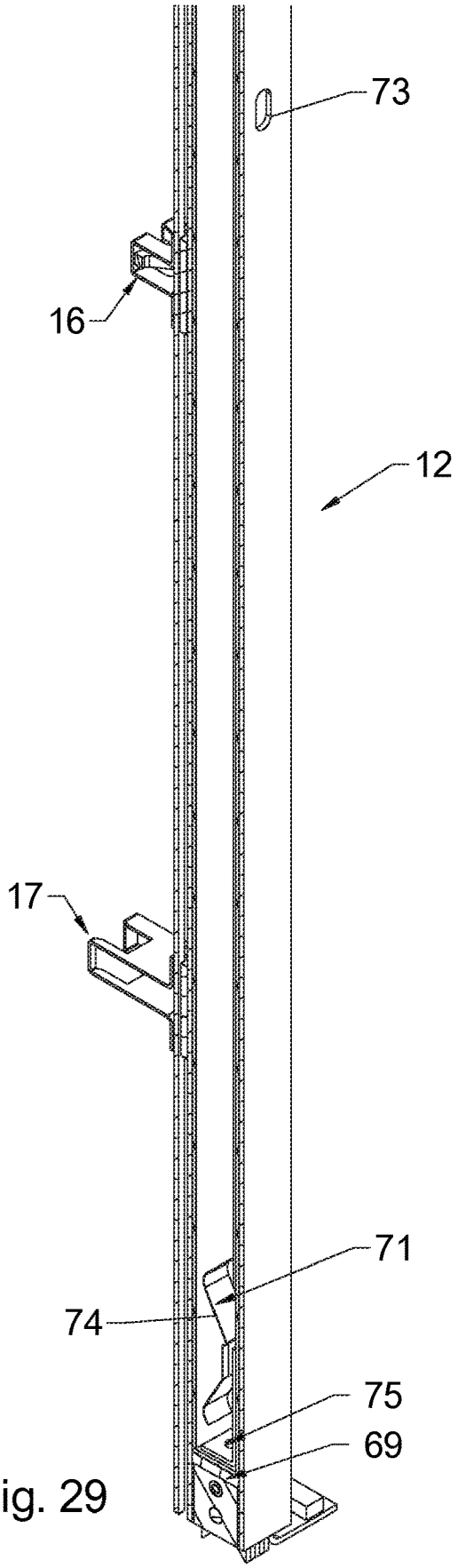
FIG. 29 is a sectional view of the support post of FIG. 28 in a fully retracted state.
Figure 30:
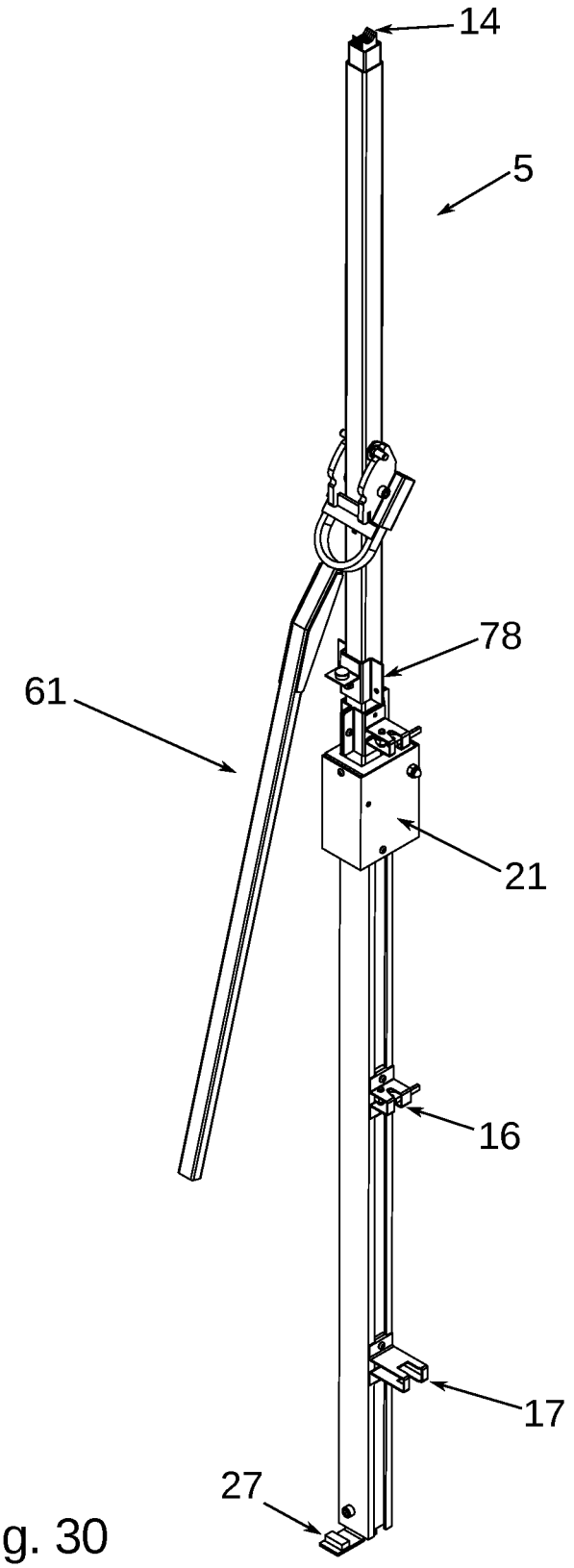
FIG. 30 is a perspective view of another embodiment of the support post with a level member releasably mounted on the first elongate member.
Figure 31:
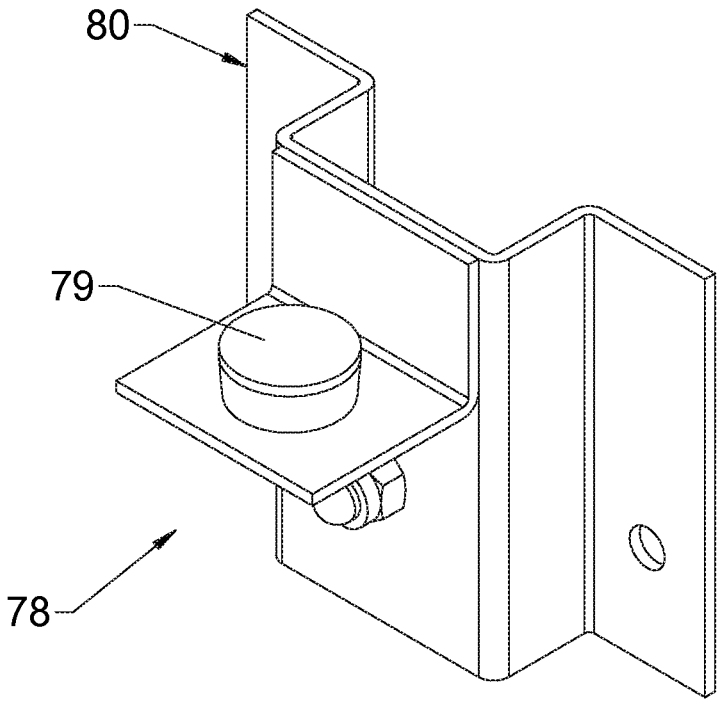
FIG. 31 is a perspective view of the level of the support post shown in FIG. 30.
Figure 32:
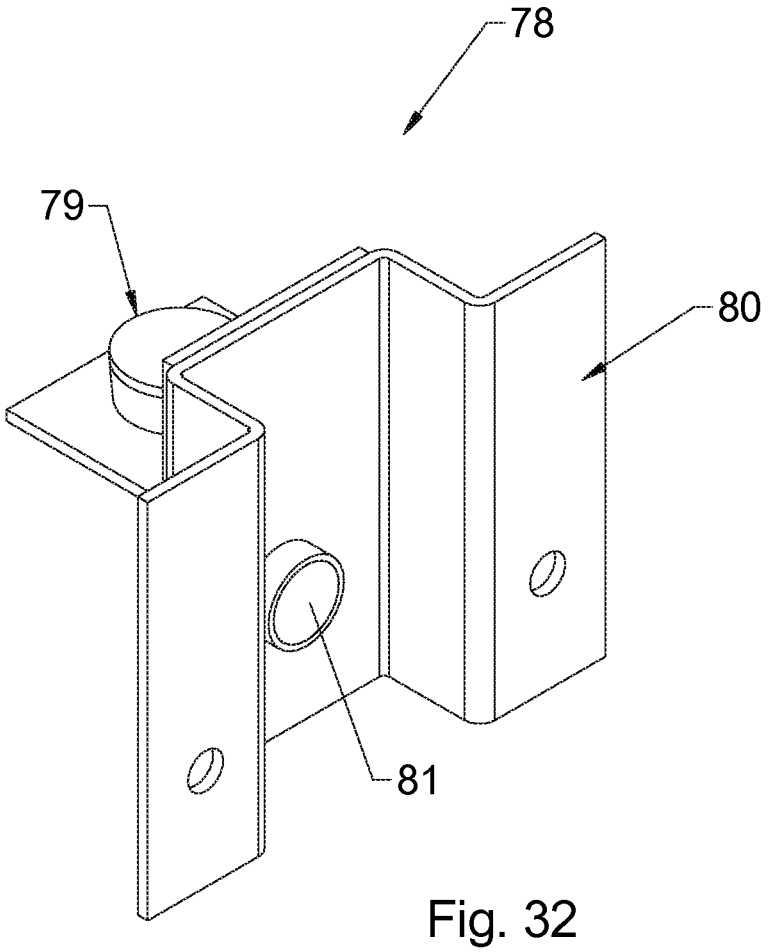
FIG. 32 is another perspective view of the level of the support post shown in FIG. 30.

In the embodiment shown in FIG. 28 and FIG. 29, support post 5 has a shock absorber 69 arranged at an upper side of second floor engaging member 15 inside second elongate member 13. Shock absorber 69 is arranged for absorbing the impact caused by the lower end of the first elongate member 12 hitting shock absorber 69 when first elongate member 12 is fully retracted into second elongate member 13. In the shown example, shock absorber 69 has an absorbing plate 70, optionally made of a rubber material.

In the embodiment shown in FIG. 28 and FIG. 29, support post 5 further has a safety device 71 preventing the first and second elongate member from being involuntarily disconnected from one another, for example during transport of support post 5. Safety device 71 has a locking member 72, for example a locking pin, connected to first elongate member 12 and a locking opening 73 at second elongate member 13. In a fully extended position of first elongate member 12 (see FIG. 28), locking member 72 is received in locking opening 73 to block further telescoping of first elongate member 12. Safety device 71 further has a spring member 74 biasing locking member 72 in direction perpendicular to longitudinal axis 12*a* of first elongate member 12. In this way, locking member 72 is urged against the inner wall of second elongate member 13 when first elongated member 12 is telescoped from second elongated member 13. As soon as locking member 72 reaches locking opening 73, spring member 74 pushes locking member 72 into locking opening 73 of second elongate member 13 to lock support post 5 in its fully extended state. In the shown example, safety device 71 further has a bracket 75 connected to locking member 72 and an impact plate 76 attached to an underside of a horizontal flange 77 of bracket 75. Impact plate 76 is arranged at an open lower end of first elongate member 12 such that impact plate 76 contacts shock absorber 69 when the first elongated member 14 is in its fully retracted state (see FIG. 29). Impact plate 76 may be an integral part of second elongated member 13.

In the embodiment shown in FIG. 30, FIG. 31, FIGS. 32 and 33, support post 5 further has a level 78 for indicating an inclination of support post 5. Level 78 may have a bubble level 79. Furthermore, level 78 has a holder 80 for arrangement at the outer surface of first elongate member 12. Holder 80 has a magnet 81 for releasably connecting level 78 to first elongate member 12. Furthermore, in FIG. 33, the first inspection window 65*a* is positioned at the lower end of the second inspection window 65*b*, since the displacement unit 49 has not been actuated.

The invention claimed is:

1. A support post for releasable fixation between a first floor and a second floor, the support post comprising:

a first elongate member and a second elongate member, the first and second elongate members being telescopically connected to one another, a first floor engaging member positioned at an upper end of the first elongate member, a second floor engaging member positioned at a lower end of the second elongate member, a displacement unit for displacing the first floor engaging member in a direction of a longitudinal axis of the first elongate member, a spring biasing the first floor engaging member in a direction away from the upper end of the first elongate member, the first floor engaging member being moveable in a direction towards the upper end of the first elongate member against a spring force of the spring, a first inspection window in the first elongate member, a second inspection window slidably arranged adjacent to the first inspection window, and an indicator, the indicator having a first marking and a second marking, the first marking being arranged at the second inspection window in a relaxed state of the spring, the second marking being arranged at the second inspection window in a loaded state of the spring.

2. The support post according to claim 1, wherein the second inspection window is coupled to a first end of the spring and the indicator is coupled to a second end of the spring such that a linear displacement of the first end of the spring leads to a linear displacement of the second inspection window by the same distance and a linear displacement of the second end of the spring leads to a linear displacement of the indicator by the same distance.

3. The support post according to claim 2, wherein the displacement unit comprises an elongate force transfer member acting on a bearing for the first end of the spring.

4. The support post according to claim 2, wherein the second end of the spring acts on the first floor engaging member.

5. The support post according to claim 3, wherein the elongate force transfer member comprises the second inspection window.

6. The support post according to claim 3, wherein the elongate force transfer member is telescopically mounted inside the first elongate member.

7. The support post according to claim 1, wherein the indicator is connected to the first floor engaging member via an elongate connector.

8. The support post according to claim 1, further comprising a bracket member having the indicator, the bracket member being slidably arranged relative to the first elongate member and an elongate force transfer member.

9. The support post according to claim 8, wherein the bracket member is rigidly connected to an elongate connector, and wherein the indicator is connected to the first floor engaging member via the elongate connector.

* * * * *